US006759382B2

(12) United States Patent
Ahmed

(10) Patent No.: US 6,759,382 B2
(45) Date of Patent: Jul. 6, 2004

(54) DETERGENT COMPOSITION CONTAINING A PRIMARY SURFACTANT SYSTEM AND A SECONDARY SURFACTANT SYSTEM, AND A METHOD OF USING THE SAME

(75) Inventor: Fahim U. Ahmed, Greensboro, NC (US)

(73) Assignee: Kay Chemical, Inc., Greensboro, NC (US)

( * ) Notice: Subject to any disclaimer, the term of this patent is extended or adjusted under 35 U.S.C. 154(b) by 242 days.

(21) Appl. No.: 09/872,149

(22) Filed: Jun. 1, 2001

(65) Prior Publication Data

US 2003/0092594 A1 May 15, 2003

(51) Int. Cl.[7] ..... C11D 17/00

(52) U.S. Cl. ..... 510/424; 510/426; 510/428; 510/492; 510/499; 510/470; 510/382; 510/503

(58) Field of Search ..... 510/424, 426, 510/428, 492, 470, 503, 499, 382

(56) References Cited

U.S. PATENT DOCUMENTS

| | | | |
|---|---|---|---|
| 1,559 A | 4/1840 | Williams | |
| 3,741,915 A | 6/1973 | Paviak | |
| 4,885,379 A | 12/1989 | Abend | |
| 4,919,839 A | 4/1990 | Durbut et al. | |
| 5,167,874 A | 12/1992 | Borland et al. | |
| 5,415,812 A | 5/1995 | Durbut et al. | |
| 5,534,500 A | 7/1996 | Casamassina et al. | |
| 5,545,622 A | 8/1996 | Casamassina et al. | |
| 5,556,577 A | 9/1996 | Gomes et al. | |
| 5,637,758 A | 6/1997 | Sajic et al. | 560/147 |

FOREIGN PATENT DOCUMENTS

| | | |
|---|---|---|
| DE | 40 36 662 A 1 | 5/1992 |
| DE | 41 02 745 A 1 | 8/1992 |
| DE | 41 34 770 A 1 | 4/1993 |
| EP | 0 070 076 A2 | 1/1983 |
| EP | 0 337 406 A1 | 10/1989 |
| EP | 0 423 968 A1 | 4/1991 |
| EP | 0 509 608 A2 | 10/1992 |
| EP | 0 633 308 A1 | 1/1995 |
| JP | 51-47007 | 4/1976 |
| JP | 4-47000 | 2/1992 |
| JP | 4-292695 | 10/1992 |
| JP | 5-98289 | 4/1993 |
| JP | 5-171199 | 7/1993 |
| JP | 5-239493 | 9/1993 |
| JP | 6-340891 | 12/1994 |
| JP | 8-53694 | 2/1996 |
| JP | 8-134500 | 5/1996 |
| WO | WO 92/06162 | 4/1992 |
| WO | WO 96/22347 | 7/1996 |
| WO | WO 96/24655 | 8/1996 |

*Primary Examiner*—Necholus Ogden

(57) ABSTRACT

The present invention relates to a novel super-concentrated, liquid detergent composition comprising a primary surfactant system, a secondary surfactant system, and water. In this composition, the primary surfactant system comprises at least one primary surfactant chosen from a linear alkyl benzene sulfonic acid, a linear alkyl benzene sulfonate, an α-olefin sulfonate, an alcohol ether sulfate, an alkyl sulfate, and alkali metal, alkaline earth metal, amine and ammonium salts thereof, the secondary surfactant system comprises at least one secondary surfactant chosen from an alkyl polyglycoside and an α-sulfomethyl ester, and the weight ratio of the at least one primary surfactant to the at least one secondary surfactant, based on the solids content of the detergent composition, is at least 3:1. When the secondary surfactant system comprises only an α-sulfomethyl ester as the secondary surfactant, the weight ratio of the at least one primary surfactant to the α-sulfomethyl ester, based on the solids content of the detergent composition, is at least 2.7:1. The invention also relates to a method for cleaning soiled dishware, pots and/or pans comprising contacting the soiled dishware, pots and/or pans with these novel detergent compositions, and subsequently removing the soil from the dishware.

56 Claims, No Drawings

DETERGENT COMPOSITION CONTAINING A PRIMARY SURFACTANT SYSTEM AND A SECONDARY SURFACTANT SYSTEM, AND A METHOD OF USING THE SAME

FIELD OF THE INVENTION

The present invention relates to all-purpose, super concentrated liquid detergent compositions. Specifically, it relates to a super concentrated liquid detergent for cleaning dishware. In particular, the invention relates to a novel liquid detergent composition comprising a primary surfactant system, a secondary surfactant system, and water, in which the ratio of a primary surfactant contained in the primary surfactant system to a secondary surfactant contained in the secondary surfactant system, based on the solids content of the detergent composition, is at least 2.7:1.

BACKGROUND OF THE INVENTION

Liquid detergent compositions have been widely used for the washing of dishware, either manually or automatically, for some time. Consumers generally select a liquid detergent composition based on a variety of factors, all weighted differently by the individual consumer. These factors include the liquid detergent composition's cost, its ability to cut grease, its ability to maintain and generate foam or suds, and, when used to manually wash dishware, its mildness when brought in contact with the users skin. Superiority in only one of these factors, however, will generally not be sufficient to provide a commercially acceptable product. For example, a liquid detergent composition that is superior in its ability to cut grease may contain an excessive amount of anionic and nonionic surfactants, which may cause the composition to irritate the skin of the consumer during use. Additionally, a liquid detergent composition that is significantly less expensive that its competitors will generally contain less surfactants, the cleaning component of the detergent composition, and thus reduce the cleaning ability of the liquid detergent.

Therefore, there exists a need to provide a liquid detergent composition that is inexpensive to manufacture, has superior grease cutting ability, provides long-lasting foam or suds, and is mild to the human skin upon contact. To date, no product that has the unique combination of superior cleaning performance, acceptable mildness to the skin, and cost-effectiveness is commercially available.

A search of relevant prior art indicates that the present invention is novel and nonobvious. European Patent No. EP 070,076 discloses a composition comprising a linear alkyl benzene sulfonic acid, linear alkyl benzene sulfonate and alkali metal, alkaline earth metal, amine and ammonium salts thereof (herein referred to as "LAS" surfactants), in combination with an alkyl polyglycoside (herein referred to as "APG" surfactants). However, the ratio of the LAS surfactant to the APG surfactant according to this document does not approach the high primary-to-secondary surfactant ratio of the present invention.

European Patent No. EP 509,608 similarly discloses a light liquid detergent composition comprising an LAS surfactant and an APG surfactant. This document, however, also fails to disclose the high primary-to-secondary surfactant ratio of the present invention.

U.S. Pat. No. 4,919,839, U.S. Pat. No. 5,415,812, and International Publication No. WO 96/22347 disclose, for example, additional compositions containing an LAS surfactant, as well as other primary surfactants according to this invention. International Publication No. WO 96/24655 describes a light duty cleaning composition comprising 10–30% by weight of an alkyl ether sulphate and alkyl sulphate, and at least 1% by weight alcohol ethoxylate, thus also disclosing several of the primary surfactants according to this invention. U.S. Pat. Nos. 5,545,622 and 5,534,500 describe compositions comprising an alkyl polyglycoside. Thus, while the individual components according to the present invention may be individually known, none of the documents disclosing the individual components, however, disclose the high primary-to-secondary surfactant ratio of the present invention.

SUMMARY OF THE INVENTION

The all-purpose super concentrated liquid detergent composition according to the present invention for the first time possess the highly desirable combination of high initial and lasting foaming and emulsifying properties, optimal cost and improved mildness, performance, and stability characteristics, and this unique combination of properties is directly attributable to the detergent compositions recited in the appended claims. An object of the present invention is to provide an all-purpose, super-concentrated, liquid detergent composition that was optimized for cost and performance.

Another object of the present invention is to provide a super concentrated liquid detergent composition that has a cleaning performance that meets or exceeds the performance of other leading brand detergent compositions.

Another object of the present invention is to provide a super concentrated liquid detergent composition that is mild and does not irritate the skin during and after use.

An additional object of the present invention is to provide a super concentrated liquid detergent composition that can be used in manual cleaning operations to clean a variety of dishware, including dishes, cooking utensils, cutlery, tumblers, crockery, pots and pans.

These and additional objects and advantages of the present invention will be apparent from the description, or may be learned by practice of the invention. The objects and advantages of the invention will be realized by the elements and combinations particularly pointed out in the appended claims.

DETAILED DESCRIPTION OF THE INVENTION

To achieve these and other objectives, and in accordance with the purpose of the invention as embodied and broadly described herein, the present invention provides a detergent composition comprising a primary surfactant system, a secondary surfactant system, and water, wherein the primary surfactant system comprises at least one primary surfactant chosen from a linear alkyl benzene sulfonic acid, a linear alkyl benzene sulfonate, an α-olefin sulfonate, an alcohol ether sulfate, an alkyl sulfate, and alkali metal, alkaline earth metal, amine and ammonium salts thereof, the secondary surfactant system comprises at least one secondary surfactant chosen from an alkyl polyglycoside and an α-sulfomethyl ester, and the weight ratio of the at least one primary surfactant to the at least one secondary surfactant, based on the solids content of the detergent composition, is at least 3:1.

It is also an object of the present invention to provide a detergent composition comprising a primary surfactant system, a secondary surfactant system, and water, wherein the primary surfactant system comprises a) at least one linear $C_{10}$–$C_{16}$ alkyl benzene sulfonic acid, linear $C_{10}$–$C_{16}$ alkyl benzene sulfonate or alkali metal, alkaline earth metal; amine and ammonium salt thereof; and b) at least one additional primary surfactant chosen from an α-olefin sulfonate, an alcohol ether sulfate, an alkyl sulfate, and alkali metal, alkaline earth metal, amine and ammonium salts thereof, the secondary surfactant system comprises at least one secondary surfactant chosen from an alkyl polyglycoside and an α-sulfomethyl ester, and the weight ratio of the at least one primary surfactant to the at least one secondary surfactant, based on the solids content of the detergent composition, is at least 3:1.

It is an additional object of the present invention to provide a detergent composition comprising a primary surfactant system, a secondary surfactant system, and water, wherein the primary surfactant system comprises at least one primary surfactant chosen from a linear alkyl benzene sulfonic acid, a linear alkyl benzene sulfonate, an α-olefin sulfonate, an alcohol ether sulfate, an alkyl sulfate, and alkali metal, alkaline earth metal, amine and ammonium salts thereof, the secondary surfactant system comprises at least one α-sulfomethyl ester as a secondary surfactant, and the weight ratio of the at least one primary surfactant to the at least one secondary surfactant, based on the solids content of the detergent composition, is at least 2.7:1.

It is yet another object of the present invention to provide a detergent composition comprising a primary surfactant system, a secondary surfactant system, and water, wherein the primary surfactant system comprises a) at least one linear $C_{10}$–$C_{16}$ alkyl benzene sulfonic acid or alkali metal, alkaline earth metal, amine and ammonium salt thereof chosen from dodecylbenzene sulfonic acid, magnesium dodecylbenzene sulfonate, sodium dodecylbenzene sulfonate, triethanolammonium dodecylbenzene sulfonate, magnesium/sodium dodecylbenzene sulfonate, and magnesium/sodium/ triethanol ammonium dodecylbenzene sulfonate, and b) at least one alcohol ether sulfate having 1 to 4 moles of ethoxylation; wherein the secondary surfactant system comprises at least one $C_8$to $C_{16}$ alkyl polyglycoside with a degree of polymerization ranging from 1 to 3, and wherein the weight ratio of the at least one linear $C_{10}$–$C_{16}$ alkyl benzene sulfonic acid or alkali metal, alkaline earth metal, amine and ammonium salt thereof to the at least one $C_8$to C16 alkyl polyglycoside, based on the solids content of the detergent composition, ranges from 3:1 to 5:1.

It is a further object of the present invention to provide a detergent composition comprising a primary surfactant system, a secondary surfactant system, and water, wherein the primary surfactant system comprises a) at least one linear $C_{10}$–$C_{16}$ alkyl benzene sulfonic acid or alkali metal, alkaline earth metal, amine and ammonium salt thereof chosen from dodecylbenzene sulfonic acid, magnesium dodecylbenzene sulfonate, sodium dodecylbenzene sulfonate, triethanolammonium dodecylbenzene sulfonate, magnesium/sodium dodecylbenzene sulfonate, and magnesium/sodium/triethanolammonium dodecylbenzene sulfonate, and b) at least one alcohol ether sulfate having 1 to 4 moles of ethoxylation; wherein the secondary surfactant system comprises at least one α-sulfomethyl ester, and wherein the weight ratio of the at least one linear $C_{10}$–$C_{16}$ alkyl benzene sulfonic acid or alkali metal, alkaline earth metal, amine and ammonium salt thereof to the at least one α-sulfomethyl ester, based on the solids content of the detergent composition, ranges from 2.7:1 to 4:1.

Finally, it is an object of the present invention to provide a method for cleaning soiled dishware, the method comprising contacting the soiled dishware with a detergent composition comprising a primary surfactant system, a secondary surfactant system, and water, and removing the soil from the dishware, wherein the primary surfactant system comprises at least one primary surfactant chosen from a linear alkyl benzene sulfonic acid, a sulfonate, a linear alkyl benzenesulfonate, an α-olefin sulfonate, an alcohol ether sulfate, an alkyl sulfate, and alkali metal, alkaline earth metal, amine and ammonium salts thereof, the secondary surfactant system comprises at least one secondary surfactant chosen from an alkyl polyglycoside and an α-sulfomethyl ester, and the weight ratio of the at least one primary surfactant to the at least one secondary surfactant, based on the solids content of the detergent composition, is at least 3:1. When the secondary surfactant system comprises only an α-sulfomethyl ester as the secondary surfactant in the method for cleaning soiled dishware, the weight ratio of the at least one primary surfactant to the α-sulfomethyl ester, based on the solids content of the detergent composition, is at least 2.7:1.

According to the present invention, the term "dishware" comprises all cooking and eating instruments including dishes, utensils, cutlery, crockery, tumblers, pots and pans.

The detergent compositions according to the present invention contain a primary surfactant system. This primary surfactant system is comprised at least one primary surfactant chosen from a linear alkyl benzene sulfonic acid, a linear alkyl benzene sulfonate, an α-olefin sulfonate, an alcohol ether sulfate, an alkyl sulfate, and alkali metal, alkaline earth metal, amine and ammonium salts thereof.

With respect to the linear alkyl benzene sulfonic acid, linear alkyl benzene sulfonate, and alkali metal, alkaline earth metal, amine and ammonium salts thereof, examples of suitable primary surfactants include a linear $C_{10}$–$C_{16}$ alkyl benzene sulfonic acid, a linear $C_{10}$–$C_{16}$ alkyl benzene sulfonate, and an alkali metal, alkaline earth metal, amine and ammonium salt thereof. More preferred primary surfactants in this class can be chosen from dodecylbenzene sulfonic acid, dodecylbenzene sulfonate, decylbenzene sulfonate, undecylbenzene sulfonate, tridecylbenzene sulfonate, nonylbenzene sulfonate and alkali metal, alkaline earth metal, amine and ammonium salts thereof. In this class of primary surfactants, the most preferred surfactants can be chosen from dodecylbenzene sulfonic acid, magnesium dodecylbenzene sulfonate, sodium dodecylbenzene sulfonate, triethanolammonium dodecylbenzene sulfonate, magnesium/sodium dodecylbenzene sulfonate, and magnesium/sodium/triethanolammonium dodecylbenzene sulfonate.

In a preferred embodiment, the mole ratio of Mg:Na in the magnesium/sodium dodecylbenzene sulfonate ranges from 1:3 to 3:1, more preferably 1:1. In another preferred embodiment, the mole ratio of Mg:Na in said magnesium/sodium/triethanolammonium dodecylbenzene sulfonate ranges from 1:3 to 3:1, and the mole ratio of $(HOCH_2CH_2)_3NH$:Na in said magnesium/sodium/triethanolammonium dodecylbenzene sulfonate ranges from 0.1:1 to 1:1. In another embodiment, the mole ratio of Mg:Na:$(HOCH_2CH_2)_3NH$ in the magnesium/sodium/triethanolammonium dodecylbenzene sulfonate ranges from 1:1:0.5 to 1:1:1.

Commercially available linear alkyl benzene sulfonic acid, linear alkyl benzene sulfonate, and alkali metal, alkaline earth metal, amine and ammonium salts thereof that may be used in the present invention include BIO-SOFT® MG-50, a magnesium salt of a linear alkyl benzene sulfonate, BIO-SOFT® D-62, a sodium salt of a linear alkyl benzene sulfonate, and BIO-SOFT® 100, a linear alkyl benzene sulfonic acid, and BIO-SOFT® N-300, a triethanolammonium salt of a linear benzene sulfonate, all sold by Stepan Company.

An α-olefin sulfonate or an alkali metal, alkaline earth metal, amine and ammonium salt thereof is also suitable as the primary surfactant. Preferred α-olefin sulfonates and alkali metal, alkaline earth metal, amine and ammonium salts thereof include $C_{14}$–$C_{16}$ α-olefin sulfonate. A particularly preferred α-olefin sulfonate is sodium $C_{14}$–$C_{16}$ α-olefin sulfonate. This sodium $C_{14}$–$C_{16}$ α-olefin sulfonate may be in powdered or liquid form. Commercially available sodium $C_{14}$–$C_{16}$ α-olefin sulfonates that may be used in accordance with the present invention include BIOTERGE AS-40® and BIOTERGE A-90®, sold by Stepan Company.

Suitable alcohol ether sulfates or alkali metal, alkaline earth metal, amine and ammonium salts thereof include sulfates have from 1 to 4 moles of ethoxylation. Preferably, the alcohol ether sulfates or alkali metal, alkaline earth metal, amine and ammonium salts thereof can be chosen from ammonium laureth-1-sulfate, ammonium laureth-2-sulfate, ammonium laureth-3-sulfate, ammonium myreth-3-sulfate, sodium laureth-1-sulfate, sodium laureth-2-sulfate, sodium laureth-3-sulfate and sodium myreth-3-sulfate. Commercially available alcohol ether sulfates or salts thereof that may be used in accordance with the present invention include STEOL® CA-460, an ammonium laureth sulfate with 4 moles of ethoxylation in 60% active, STEOL® CS-270, a sodium laureth sulfate with 2 moles of ethoxylation in 70% active, and STEOL® CA-230, an ammonium laureth sulfate with 2 moles of ethoxylation in 26% active, all sold by Stepan Company, as well as TEXAPON® NC-70, an alcohol ether sulfate with 2 moles of ethoxylation in 70% active, sold by Henkel Corporation. Examples of sodium lauryl ether sulfates with 3 moles of ethoxylation in 60% active that are commercially available include SULFOTEX® NL60S and SULFOTEX® 6040S, both also sold by Henkel Corporation.

With respect to the alkyl sulfates, and alkali metal, alkaline earth metal, amine and ammonium salts thereof that are suitable for the primary surfactant according to the present invention, mention may be made of lauryl sulfates and salts thereof. Preferred lauryl sulfates include sodium lauryl sulfate, magnesium lauryl sulfate, ammonium lauryl sulfate and triethanolammonium lauryl sulfate. Sodium lauryl sulfate is particularly preferred in the present invention. Examples of commercially available sodium lauryl sulfates that are suitable in the present invention include those obtained from Stepan Company under the tradename STEPANOL®, for example STEPANOL® WAC (29% active), and also from Henkel Corporation under the tradename STANDAPOL®, for example STANDAPOL® WAQ (29% active).

In one embodiment of the present invention, the primary surfactant system is present in an amount ranging from 5 to 40% by weight, based on the weight of the detergent composition. Preferably, the primary surfactant system is present in an amount ranging from 8 to 35% by weight, more preferably 10 to 30% by weight, based on the weight of the detergent composition.

In another embodiment of the present invention, the primary surfactant system contains a mixture of primary surfactants comprising a) at least one linear $C_{10}$–$C_{16}$ alkyl benzene sulfonic acid, linear $C_{10}$–$C_{16}$ alkyl benzene sulfonate or alkali metal, alkaline earth metal, amine and ammonium salt thereof; and b) at least one additional primary surfactant chosen from an α-olefin sulfonate, an alcohol ether sulfate, an alkyl sulfate, and alkali metal, alkaline earth metal, amine and ammonium salts thereof. Preferably, the at least one linear $C_{10}$–$C_{16}$ alkyl benzene sulfonic acid, linear $C_{10}$–$C_{16}$ alkyl benzene sulfonate or alkali metal, alkaline earth metal, amine and ammonium salts thereof is chosen from dodecylbenzene sulfonic acid, magnesium dodecylbenzene sulfonate, sodium dodecylbenzene sulfonate, magnesium/sodium dodecylbenzene sulfonate and magnesium/sodium/triethanolamine dodecylbenzene sulfonate; and the at least one additional primary surfactant is chosen from an alcohol ether sulfate and an alkali metal, alkaline earth metal, amine and ammonium salt thereof having 1 to 4 moles of ethoxylation. The at least one additional primary surfactant is preferably present in an amount ranging from 5 to 30% by weight, based on the weight of the detergent composition.

The detergent composition according to the present invention also contains a secondary surfactant system. This secondary surfactant system is comprised of at least one secondary surfactant chosen from, but not limited to, an alkyl polyglycoside and an α-sulfomethyl ester. Thus, these two secondary surfactants can be used alone, or in combination with one another.

In one embodiment of the present invention, the alkyl polyglycoside can be chosen from a $C_8$to $C_{16}$ alkyl polyglycoside. Suitable $C_8$to $C_{16}$ alkyl polyglycosides have the following chemical structure:

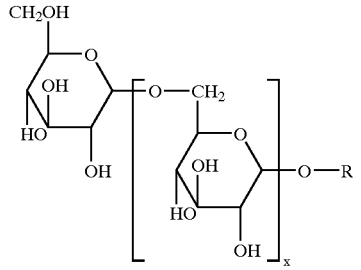

wherein R is an alkyl group having 8 to 16 carbon atoms, and x ranges from 0 to 3. Examples of commercially available alkyl polyglycosides are fatty alcohol polyglycosides sold by Henkel Corporation under the tradename GLUCOPON®.

In a preferred embodiment, the $C_8$to $C_{16}$ alkyl polyglycoside is chosen from a $C_8$–$C_{10}$ alkyl polyglycoside with a degree of polymerization of 1.5 (GLUCOPON® 200), a $C_8$–$C_{10}$ alkyl polyglycoside with a degree of polymerization of 1.6 GLUCOPON® 225 CS), a $C_8$–$C_{10}$ alkyl polyglycoside with a degree of polymerization of 1.7 (GLUCOPON® 225 DK), a $C_8$–$C_{16}$ alkyl polyglycoside with a degree of polymerization of 1.45 (GLUCOPON® 425), a $C_{12}$–$C_{16}$ alkyl polyglycoside with a degree of polymerization of 1.4 (GLUCOPON® 600), a $C_8$–$C_{14}$ alkyl polyglycoside with a degree of polymerization of 1.4 (GLUCOPON® 600 EC), a $C_8$–$C_{14}$ alkyl polyglycoside with a degree of polymerization of 1.5 (GLUCOPON® 650 EC), a $C_{12}$–$C_{14}$ alkyl polyglycoside with a degree of polymerization of 1.4 (GLUCOPON® 600 CS), and a $C_{12}$–$C_{16}$ alkyl polyglycoside with a degree of polymerization of 1.6 (GLUCOPON® 625).

In another embodiment of the present invention, the at least one secondary surfactant is chosen from an α-sulfomethyl ester. In a preferred embodiment, the α-sulfomethyl ester can be represented by the following chemical structure:

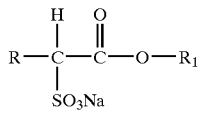

wherein R is an alkyl group having 10 to 16 carbon atoms, and $R_1$ is chosen from a methyl group and a sodium atom. More preferably, the at least one secondary surfactant is chosen from a $C_{12}$–$C_{18}$ sodium methyl α-sulfomethyl ester and a $C_{12}$–$C_{18}$ disodium α-sulfo fatty acid salt. Because more than one α-sulfomethyl ester may be present in the secondary surfactant system, the present invention contemplates the use of both sodium methyl α-sulfomethyl ester and the disodium α-sulfo fatty acid salt in the secondary surfactant system. Commercially available sodium α-sulfomethyl esters that may be used in accordance with the present invention include ALPHA-STEP® ML-40 and ALPHA-STEP®, both sold by Stepan Company. A mixture of sodium methyl 2-sulfolaurate and disodium 2-sulfolaurate is preferred.

In one embodiment of the present invention, the secondary surfactant system is present in an amount ranging from 2 to 30% by weight, based on the weight of the detergent composition. Preferably, the secondary surfactant system is present in an amount ranging from 4 to 25% by weight, more preferably 5 to 20% by weight, based on the weight of the detergent composition.

In an embodiment of the present invention wherein the secondary surfactant system comprises at least one alkyl polyglycoside, the weight ratio of the at least one primary surfactant to the at least one secondary surfactant, based on the solids content of said detergent composition, is at least 3:1. Preferably, the weight ratio of the at least one primary surfactant to the at least one secondary surfactant ranges from 3:1 to 6:1. In another embodiment, the weight ratio of the at least one primary surfactant to the at least one secondary surfactant ranges from 3.5:1 to 5:1, more preferably from 4:1 to 5:1. In yet another embodiment, the weight ratio of the at least one primary surfactant to the at least one secondary surfactant is 4:1.

In an embodiment of the present invention wherein the secondary surfactant system comprises at least one α-sulfomethyl ester as the secondary surfactant, the weight ratio of the at least one primary surfactant to the at least one secondary surfactant, based on the solids content of the detergent composition, is at least 2.7:1. Preferably, the weight ratio of the at least one primary surfactant to the at least one secondary surfactant ranges from 3:1 to 6:1. In another embodiment, the weight ratio of the at least one primary surfactant to the at least one secondary surfactant ranges from 3:1 to 5:1, more preferably from 3.25:1 to 5:1.

The liquid detergent composition according to the present invention can further contain at least one alkanolamide. In one embodiment, the at least one alkanolamide is a lower alkanolamide of a higher alkanoic acid. Preferably, the at least one alkanolamide is a mono-alkanolamide chosen from lauryl/myristic monoethanolamide and coco monoethanolamide. Examples of commercially available alkanolamides suitable for the present invention include NINOL® LMP, a lauramide/myristamide MEA sold by Stepan Company, and MACKAMIDE® LMM, a lauramide MEA sold by McIntyre Group. In one embodiment, the at least one alkanolamide can be present in an amount ranging from 0.5 to 10% by weight, based on the weight of the detergent composition.

The liquid detergent composition according to the present invention can further contain at least one amphoteric surfactant. In one embodiment, the at least one amphoteric surfactant is chosen from betaines and amphoacetates. Suitable betaines include cocoamidopropyl betaine, and suitable amphoacetates include sodium cocoamphoacetate, sodium lauroamphoacetate and sodium cocoamphodiacetate. Commercially available amphoteric surfactants that may be used in accordance with the present invention include VELVETEX® BA-35 sold by Henkel Corporation, AMPHOSOL® CA and AMPHOSOL® CG sold by Stepan Company, TEGO Betaines sold by Goldschmidt, MACKAM® 35 and MACKAM® IL sold by McIntyre Group, and MIRATAINE® CB and MIRANOL HMA sold by Rhone-Poulenc. In one embodiment, the at least one amphoteric surfactant is present in an amount ranging from 0.5 to 10% by weight, based on the weight of the detergent composition.

The liquid detergent composition according to the present invention can also additionally contain at least one antibacterial agent. In one embodiment, the at least one antibacterial agent is chosen from 2,4,4'-trichloro-2'-hydroxydiphenyl ether (also known as triclosan) having the following structural formula:

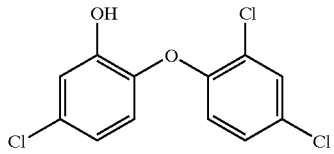

and 4-chloro-3,5-dimethyl phenol (also known as PCMX) having the following structural formula:

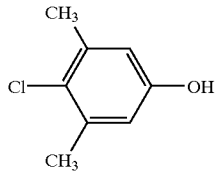

In one embodiment, the least one antibacterial agent is present in an amount ranging from 0.1 to 10% by weight, preferably 0.15 to 8 percent by weight, and more preferably about 0.25 to about 6 percent by weight based on the weight of the detergent composition. If only one antibacterial agent is present, the amount generally ranges from 0.1 to 8% by weight, preferably 0.2 to about 6 percent by weight, and more preferably about 0.2 to about 4 percent by weight based on the weight of the detergent composition. Triclosan is commercially available and sold under the tradename IRGASAN® and IRGASAN DP 300® by Ciba-Geigy. PCMX is commercially available and sold under the tradename NIPACIDE PX® and NIPACIDE PX-R® by Nipa Laboratories.

The antimicrobial properties of the detergent composition can be further enhanced by adding of a compound having the following structure or a salt thereof:

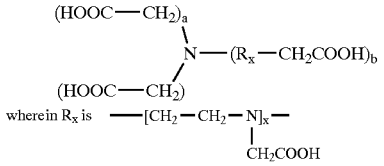

x is 0–5, preferably 1–3; and a and b are independently 0, 1 or 2, provided that $2 \leqq a+b \leqq 3$. The salts of the compound comprise those based on the Group IA metals (i.e., Li, Na, K, Rb, or Cs) or Group IIA alkaline earth metals (i.e., Be, Mg, Ca, Sr or Ba), ammonia, amines or hydroxylamines. The preferred salts comprise the alkali metal salts, especially the sodium salts.

More preferably, a, b and x are each 1, to provide ethylenediamine tetraacetic acid or a salt thereof (a.k.a. "EDTA") in the composition. Most preferably, a tetrasodium salt of ethylenediamine tetraacetic acid ("EDTA-$Na_4$") having the following formula is employed in the composition:

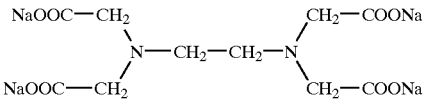

In one embodiment of the present invention, the EDTA-$Na_4$ compound is present in an amount ranging from 0.025 to 8 percent by weight, more preferably 0.05 to 6 percent by weight, and more preferably from 0.1 to 4 percent by weight, based on the weight of the detergent composition.

The antimicrobial properties of the detergent composition can also be further enhanced by the addition of glutaraldehyde, which has the following structural formula:

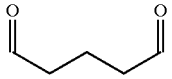

In one embodiment of the present invention, the glutaraldehyde is present in an amount ranging from 0.025 to 8 percent by weight, more preferably 0.05 to 6 percent by weight, and more preferably from 0.1 to 4 percent by weight, based on the weight of the detergent composition.

The detergent composition according to the present invention can additionally contain at least one additive chosen from an additional secondary surfactant other than said alkyl polyglycoside and said α-sulfomethyl ester, a hydrotrope, a preservative, a perfume, a thickener, and a dye. Suitable additional secondary surfactants include, for example, $C_8$–$C_{18}$ sulfosuccinates, $C_8$–$C_{18}$ sulfosuccinamates, $C_8$–$C_{18}$ surcosinates, and alkali metal, alkaline earth metal, amine and ammonium salts thereof. Sodium salts are particularly preferred, as are mono-alkyl derivatives over di-alkyl derivatives. Suitable hydrotropes included aryl sulfonates such as, for example, sodium xylene sulfonate and sodium cumene sulfonate.

EXAMPLES

The examples which follow are intended to illustrate the invention without, however, limiting its scope. The following tables set forth numerous compositions embraced by the present invention, as well as demonstrate the advantageous properties associated with the detergent compositions according to the invention.

TABLE 1

| | Formula # 102-73-1 | | Formula # 102-73-2 | | Formula # 102-75-3 | | Formula # 102-75-4 | | Formula # 102-75-5 | |
|---|---|---|---|---|---|---|---|---|---|---|
| Ingredients | Conc. % | Solids % | Conc. % | Solids % | Conc. % | Solids % | Conc. % | Solids % | Conc. % | Solids % |
| Water | 18.5 | 0 | 19 | 0 | 21.7 | 0 | 22.67 | 0 | 24.5 | 0 |
| Mg Dodecyl Benzene Sulfonate (Biosoft Mg 50) | 36 | 18 | 36 | 18 | 48 | 24 | 51.08 | 25.54 | 36 | 18 |
| Coco DEA (Standamid SD-K) | 3 | 3 | 5 | 5 | 2.7 | 2.7 | 2.7 | 2.7 | 3 | 3 |
| Ethoxylated Alcohol (Neodol 1-9) | 5 | 5 | 5 | 5 | 0 | 0 | 0 | 0 | 3 | 3 |
| Cocoamidopropyl Betaine (Velvetex BA-35) | 9 | 3.15 | 10 | 3.5 | 7.6 | 2.66 | 7.6 | 2.66 | 8.5 | 2.975 |
| Alkyl Poly Glucoside (Glucopon 625 FE) | 15 | 6 | 15 | 6 | 20 | 8 | 15.95 | 6.38 | 15 | 6 |
| Alcohol Ether Sulfate - 4EO (Steol CS 460) | 8.5 | 5.1 | 10 | 6 | 0 | 0 | 0 | 0 | 5 | 3 |
| Ethanol (SDA-3A) | 5 | 5 | 0 | 0 | 0 | 0 | 0 | 0 | 5 | 5 |
| | 100 | 45.25 | 100 | 43.5 | 100 | 37.36 | 100 | 37.28 | 100 | 40.975 |
| Properties | | | | | | | | | | |
| Mg:Na in LAS (Mole Ratio) | Mg(1) | | Mg(1) | | Mg(1) | | Mg(1) | | Mg(1) | |
| LAS:APG (Solids Content Weight Ratio) | 3:1 | | 3:1 | | 3:1 | | 4:1 | | 3:1 | |
| Primary:Secondary (Solids Content Weight Ratio) | 3.85:1 | | 4:1 | | 3:1 | | 4:1 | | 3.5:1 | |
| Foam Height - Initial, mL | 430 | | 350 | | 400 | | 410 | | 415 | |
| Foam Height with Soil, mL | 370 | | 315 | | 340 | | 335 | | 265 | |
| Foam Height - Regeneration, mL | 300 | | 325 | | 285 | | 285 | | 255 | |
| Grease Emulsification - Initial | 1 | | 1 | | 1 | | 1 | | 1 | |
| Pellet Sudge End Point | 17 | | 16 | | 17 | | 18 | | 16 | |

The compositions in Table 1 were formulated and the performance properties of each was evaluated by both the cylinder test method and the pellet test method. In the cylinder test method (TEC-TM-036), the initial foam, emulsification, emulsion stability and foam stability of the compositions was measured. According to the cylinder test, a 10% dilution of each composition was prepared in a 150 mL beaker with tap water (60–100 ppm Hardness). A water bath or sink was filled with 120° F. water. 90 mL of the tap water and 10 mL of its respective 10% product dilution was added to a 500 mL stoppered graduated cylinder, and the cylinders for each composition were labeled. The stoppers for each cylinder was then loosened, and the cylinders were immersed in the water bath (at 120±2° F.) for 10–15 minutes. The cylinders were then removed from the water bath and the stoppers for each cylinder was tightened. Each cylinder was then inverted back and forth 5–10 times. The height of the foam was recorded as the initial foam.

Ten drops of a liquid soil was added to each cylinder. Used shortening was received from a local McDonald's restaurant, was melted and was used as the liquid soil. The cylinders were recapped and inverted 5 to 10 times to observe the emulsification of the composition. Each emulsion was graded based on the following scale:

1=Uniform milky appearance, excellent;

2=Good emulsion;

3=Average emulsion;

4=Poor emulsion;

5=Very poor. Oil not suspended in emulsion.

The cylinders were then shaken another 15 times and the foam height was recorded. The cylinders were then placed back on the bench, and every 2 to 3 minutes, the foam height was recorded.

After the complete breakdown of the foam, foam regeneration was tested by stoppering the cylinders, shaking each cylinder 15 times, and recording the initial height of the regenerated foam.

In the pellet test (TEC-TM-039), the amount of foam a composition can sustain when exposed to an increasing amount of soil was measured. In order to perform this test, pellets were first prepared in the following manner. 25.0 grams of flour (Martha White), 10.0 grams of potato powder (Idaho instant) and 12.5 grams of whole egg powder are mixed thoroughly in a beaker. In a separate beaker, 37.5 grams of Crisco shortening and 15 grams of olive oil (Bertoli extra virgin) are mixed. A tray was covered with wax paper, and a template containing holes 11 mm in diameter×6.5 mm in depth was placed on the tray. The shortening and oil were mixed and melted, and when the mixture's temperature reached 160 to 180° F., the flour, potato and egg powder mixture was added to it. Mixing continued until a uniform a brownish slurry was produced, and this uniform slurry was poured over the holes in the template. The tray was then placed on a level surface in a freezer for 15 to 20 minutes.

The tray was then removed, and the excess hardened slurry was scraped from the template. The pellets were equal in diameter and flush with both the top and the bottom of the template. The pellets were then removed from the template, and placed in the freezer in a beaker covered with plastic wrap until needed for testing. The pellets average weight was 0.64±0.06 grams.

According to the pellet test, a plastic tub, containing the Kitchen Aid mixer, was filled with water to approximately 1½ inches below the edge of the stainless steel bowl of the mixer. An immersion heater and stirrer were attached to the plastic tub, and the temperature of the water in the plastic tub was stabilized at 120±1° F. The stirrer was turned on and its speed adjustment was set to approximately 4.

The needed amount of concentrate to make the required dilution in fluid ounces per gallon was weighed into a 500 mL volumetric flask. The volumetric flask was then filled to the 500 mL mark with 130 ppm hard water. A magnetic bar was then inserted into the volumetric flask, and the dilution was mixed well. The dilution was then transferred to the stainless steel bowl, and the kitchen mixer was operated at the setting "2". The dilution was stirred at this setting for exactly 5 minutes. The speed of the kitchen mixer was then reduced to "stir" and 2 pellets were immediately added. Two additional pellets were initially added every minute, followed by the addition of a single pellet until a quarter sized break in the foam was first observed. This was the end point of the pellet test. The number of pellets used for each composition was recorded, and the higher the number of pellets used, the better the foaming and emulsification properties of the tested composition.

All of the compositions set forth in Table 1 achieved an excellent emulsion rating, and demonstrated very good foaming properties. Formula #102-75-4, a composition with a weight ratio of primary surfactant to secondary surfactant of 4:1, and an LAS:APG weight ratio of 4:1 possessed the best overall foaming and emulsification properties in Table 1.

TABLE 2

| | Formula # 102-77-1 | | Formula # 102-77-2 | |
|---|---|---|---|---|
| Ingredients | Conc. % | Solids % | Conc. % | Solids % |
| Water | 25.25 | 0 | 27.75 | 0 |
| Mg Dodecyl Benzene Sulfonate (Biosoft Mg 50) | 44 | 22 | 39 | 19.5 |
| Lauramide/Myristamide MEA (Ninol NMP) | 4 | 4 | 4 | 4 |
| Alkyl Poly Glucoside (Glucopon 625 FE) | 13.75 | 5.5 | 16.25 | 6.5 |
| Alcohol Ether Sulfate - 2EO (Texapon NC 70) | 8 | 5.6 | 8 | 5.6 |
| Ethanol (SDA-3A) | 5 | 5 | 5 | 5 |
| | 100 | 42.1 | 100 | 40.6 |
| Properties | | | | |
| Mg:Na in LAS (Mole Ratio) | Mg(1) | | Mg(1) | |
| LAS:APG (Solids Content Weight Ratio) | 4:1 | | 3:1 | |
| Primary:Secondary (Solids Content Weight Ratio) | 5:1 | | 3.9:1 | |
| Foam Height - Initial, mL | 440 | | 425 | |
| Foam Height with Soil, mL | 380 | | 360 | |
| Foam Height - Regeneration, mL | 295 | | 290 | |
| Grease Emulsification - Initial | 1 | | 1 | |

TABLE 2-continued

| Ingredients | Formula # 102-77-1 Conc. % | Formula # 102-77-1 Solids % | Formula # 102-77-2 Conc. % | Formula # 102-77-2 Solids % |
|---|---|---|---|---|
| Deemulsification - 1–2 weeks (1 > 2 > 3 > 5) | 1/1 | | 1/1 | |
| Pellet Sudge End Point | 15/17 | | 16/16 | |

TABLE 3

| Ingredients | Formula # 102-78-1 Conc. % | Formula # 102-78-1 Solids % | Formula # 102-78-2 Conc. % | Formula # 102-78-2 Solids % | Formula # 102-79-1 Conc. % | Formula # 102-79-1 Solids % | Formula # 102-79-2 Conc. % | Formula # 102-79-2 Solids % | Formula # 102-79-3 Conc. % | Formula # 102-79-3 Solids % | Formula # 102-79-4 Conc. % | Formula # 102-79-4 Solids % |
|---|---|---|---|---|---|---|---|---|---|---|---|---|
| Water | 43.68 | 0 | 46.58 | 0 | 43.05 | 0 | 39.7 | 0 | 44.03 | 0 | 40.97 | 0 |
| Dodecyl Benzene Sulfonic Acid (Biosoft S-100) | 25 | 25 | 22 | 22 | 25 | 25 | 25 | 25 | 22 | 22 | 22 | 22 |
| Magnesium Oxide | 1 | 1 | 0.88 | 0.88 | 0.8 | 0.8 | 0 | 0 | 0.7 | 0.7 | 0 | 0 |
| Sodium Hydroxide (50%) | 2.32 | 1.16 | 2.04 | 1.02 | 3.15 | 1.575 | 6.3 | 3.15 | 2.77 | 1.385 | 5.53 | 2.765 |
| Lauramide/Myristamide MEA (Ninol NMP) | 4 | 4 | 4 | 4 | 4 | 4 | 4 | 4 | 4 | 4 | 4 | 4 |
| Alkyl Poly Glucoside (Glucopon 625 FE) | 15 | 6 | 17.5 | 7 | 15 | 6 | 15 | 6 | 17.5 | 7 | 17.5 | 7 |
| Alcohol Ether Sulfate - 2EO (Texapon NC 70) | 4 | 2.8 | 4 | 2.8 | 4 | 2.8 | 4 | 2.8 | 4 | 2.8 | 4 | 2.8 |
| Magnesium Chloride | 0 | 0 | 0 | 0 | 0 | 0 | 1 | 1 | 0 | 0 | 1 | 1 |
| Ethanol (SDA-3A) | 5 | 5 | 3 | 3 | 5 | 5 | 5 | 5 | 5 | 5 | 5 | 5 |
| | 100 | 44.96 | 100 | 40.7 | 100 | 45.175 | 100 | 46.95 | 100 | 42.885 | 100 | 44.565 |
| Properties | | | | | | | | | | | | |
| Mg:Na in LAS (Mole Ratio) | 1.7:1 | | 1.7:1 | | 1:1 | | Na(1)/Mg + 2(0) | | 1:1 | | Na(1)/Mg + 2(0) | |
| LAS:APG (Solids Content Weight Ratio) | 4:1 | | 3:1 | | 4:1 | | 4:1 | | 3:1 | | 3:1 | |
| Primary:Secondary (Solids Content Weight Ratio) | 4.6:1 | | 3.5:1 | | 4.6:1 | | 4.6:1 | | 3.5:1 | | 3.5:1 | |
| Foam Height - Initial, mL | 475 | | 475 | | 530 | | 545 | | 550 | | 525 | |
| Foam Height with Soil, mL | 450 | | 430 | | 410 | | 415 | | 405 | | 400 | |
| Foam Height - Regeneration, mL | 240 | | 245 | | 255 | | 260 | | 260 | | 220 | |
| Grease Emulsification - Initial | 1 | | 1 | | 1 | | 3 | | 2 | | 4 | |
| Deemulsification - 1–2 weeks (1 > 2 > 3 > 4) | | | | | 1/2 | | 3/4 | | 2/3 | | 4/5 | |
| Pellet Sudge End Point | 17/16 | | 16/16 | | 16 | | 16 | | 16 | | 15 | |

TABLE 4

| Ingredients | Formula # 102-80-1 Conc. % | Formula # 102-80-1 Solids % | Formula # 102-80-2 Conc. % | Formula # 102-80-2 Solids % | Formula # 102-80-3 Conc. % | Formula # 102-80-3 Solids % | Formula # 102-80-4 Conc. % | Formula # 102-80-4 Solids % | Formula # 102-80-5 Conc. % | Formula # 102-80-5 Solids % | Formula # 102-80-6 Conc. % | Formula # 102-80-6 Solids % |
|---|---|---|---|---|---|---|---|---|---|---|---|---|
| Water | 41.92 | 0 | 40.97 | 0 | 42.03 | 0 | 40.52 | 0 | 33.87 | 0 | 46 | 0 |
| Dodecyl Benzene Sulfonic Acid (Biosoft S-100) | 24 | 24 | 24 | 24 | 24 | 24 | 21.5 | 21.5 | 24 | 24 | 19.5 | 19.5 |
| Magnesium Oxide | 1.53 | 1.53 | 1.53 | 1.53 | 1.53 | 1.53 | 1.38 | 1.38 | 1.53 | 1.53 | 1.25 | 1.25 |
| Lauramide/Myristamide MEA (Ninol NMP) | 5 | 5 | 4 | 4 | 5.44 | 5.44 | 4.5 | 4.5 | 5 | 5 | 4 | 4 |
| Alkyl Poly Glucoside (Glucopon 625 FE) | 15 | 6 | 15 | 6 | 15 | 6 | 0 | 0 | 0 | 0 | 0 | 0 |
| α-Sulfomethyl Ester (α Step MC 48) | 0 | 0 | 0 | 0 | 0 | 0 | 21.6 | 7.992 | 24 | 8.88 | 19.5 | 7.215 |
| Alcohol Ether Sulfate - 2EO (Texapon NC 70) | 4.55 | 3.185 | 6.5 | 4.55 | 4 | 2.8 | 0 | 0 | 0 | 0 | 0 | 0 |
| Alcohol Ether Sulfate - 4EO (Steol CS 460) | 0 | 0 | 0 | 0 | 0 | 0 | 6 | 3.6 | 6.6 | 3.96 | 5.5 | 3.3 |
| Sodium Xylene Sulfonate (40%) | 5 | 2 | 5 | 2 | 5 | 2 | 0 | 0 | 0 | 0 | 0 | 0 |
| Ethanol (SDA-3A) | 3 | 3 | 3 | 3 | 3 | 3 | 4.5 | 4.5 | 5 | 5 | 4.25 | 4.25 |
| | 100 | 44.715 | 100 | 45.08 | 100 | 44.77 | 100 | 43.472 | 100 | 48.37 | 100 | 39.515 |
| Properties | | | | | | | | | | | | |
| Mg:Na in LAS (Mole Ratio) | Mg(1) | | Mg(1) | | Mg(1) | | Mg(1) | | Mg(1) | | Mg(1) | |
| LAS:APG (Solids Content | 4:1 | | 4:1 | | 4:1 | | | | | | | |

TABLE 4-continued

| Ingredients | Formula # 102-80-1 Conc. % | Formula # 102-80-1 Solids % | Formula # 102-80-2 Conc. % | Formula # 102-80-2 Solids % | Formula # 102-80-3 Conc. % | Formula # 102-80-3 Solids % | Formula # 102-80-4 Conc. % | Formula # 102-80-4 Solids % | Formula # 102-80-5 Conc. % | Formula # 102-80-5 Solids % | Formula # 102-80-6 Conc. % | Formula # 102-80-6 Solids % |
|---|---|---|---|---|---|---|---|---|---|---|---|---|
| Weight Ratio) | | | | | | | | | | | | |
| LAS:SME (Solids Content Weight Ratio) | | | | | | | 2.7:1 | | 2.7:1 | | 2.7:1 | |
| Primary:Secondary (Solids Content Weight Ratio) | 4.5:1 | | 4.8:1 | | 4.5:1 | | 3.1:1 | | 3.1:1 | | 3.2:1 | |
| Foam Height - Initial, mL | 300 | | 430 | | 265 | | 505 | | 500 | | 530 | |
| Foam Height with Soil, mL | 300 | | 390 | | 285 | | 440 | | 415 | | 430 | |
| Foam Height - Regeneration, mL | 255 | | 275 | | 240 | | 310 | | 290 | | 265 | |
| Grease Emulsification - Initial | 2 | | 1 | | 3 | | 4 | | 2 | | 5 | |
| Deemulsification - 1–2 weeks (1 > 2 > 3 > 4) | 2/2 | | 1/2 | | 2/2 | | 2/2 | | 2/2 | | 2/2 | |
| Pellet Sudge End Point | 17 | | 17 | | 17 | | 15 | | 16 | | 15 | |

TABLE 5

| Ingredients | Formula # 102-81-1 Conc. % | Formula # 102-81-1 Solids % | Formula # 102-81-2 Conc. % | Formula # 102-81-2 Solids % | Formula # 102-81-3 Conc. % | Formula # 102-81-3 Solids % | Formula # 102-81-4 Conc. % | Formula # 102-81-4 Solids % | Formula # 102-81-5 Conc. % | Formula # 102-81-5 Solids % | Formula # 102-81-6 Conc. % | Formula # 102-81-6 Solids % |
|---|---|---|---|---|---|---|---|---|---|---|---|---|
| Water | 40.4 | 0 | 38.05 | 0 | 35.7 | 0 | 41.25 | 0 | 38.9 | 0 | 36.55 | 0 |
| Dodecyl Benzene Sulfonic Acid (Biosoft S-100) | 25 | 25 | 25 | 25 | 25 | 25 | 25 | 25 | 25 | 25 | 25 | 25 |
| Magnesium Oxide | 1.6 | 1.6 | 0.8 | 0.8 | 0 | 0 | 1.6 | 1.6 | 0.8 | 0.8 | 0 | 0 |
| Sodium Hydroxide (50%) | 0 | 0 | 3.15 | 1.575 | 6.3 | 3.15 | 0 | 0 | 3.15 | 1.575 | 6.3 | 3.15 |
| Lauramide/Myristamide MEA (Ninol NMP) | 4 | 4 | 4 | 4 | 4 | 4 | 4 | 4 | 4 | 4 | 4 | 4 |
| Alkyl Poly Glucoside (Glucopon 625 FE) | 15 | 6 | 15 | 6 | 15 | 6 | 0 | 0 | 0 | 0 | 0 | 0 |
| α-Sulfomethyl Ester (α Step MC 48) | 0 | 0 | 0 | 0 | 0 | 0 | 17.15 | 6.3455 | 17.15 | 6.3455 | 17.15 | 6.3455 |
| Alcohol Ether Sulfate - 2EO (Texapon NC 70) | 6 | 4.2 | 6 | 4.2 | 6 | 4.2 | 6 | 4.2 | 6 | 4.2 | 6 | 4.2 |
| Sodium Xylene Sulfonate (40%) | 5 | 2 | 5 | 2 | 5 | 2 | 0 | 0 | 0 | 0 | 0 | 0 |
| Ethanol (SDA-3A) | 3 | 3 | 3 | 3 | 3 | 3 | 5 | 5 | 5 | 5 | 5 | 5 |
| | 100 | 45.8 | 100 | 46.575 | 100 | 47.35 | 100 | 46.1455 | 100 | 46.9205 | 100 | 47.696 |
| Properties | | | | | | | | | | | | |
| Mg:Na in LAS (Mole Ratio) | Mg(1) | | 1:1 | | Na(1) | | Mg(1) | | 1:1 | | Na(1) | |
| LAS:APG (Solids Content Weight Ratio) | 4:1 | | 4:1 | | 4:1 | | | | | | | |
| LAS:SME (Solids Content Weight Ratio) | | | | | | | 4:1 | | 4:1 | | 4:1 | |
| Primary:Secondary (Solids Content Weight Ratio) | 4.9:1 | | 4.9:1 | | 4.9:1 | | 4.6:1 | | 4.6:1 | | 4.6:1 | |
| Foam Height - Initial, mL | 355 | | 550 | | 515 | | 560 | | 580 | | 525 | |
| Foam Height with Soil, mL | 305 | | 480 | | 430 | | 420 | | 435 | | 435 | |
| Foam Height - Regeneration, mL | 225 | | 260 | | 255 | | 260 | | 260 | | 175 | |
| Grease Emulsification - Initial | 3 | | 1 | | 5 | | 4 | | 2 | | 6 | |
| Deemulsification - 1–2 weeks (1 > 2 > 3 > 4) | 1/1 | | 2/3 | | 6/5 | | 3/2 | | 4/4 | | 5/6 | |
| Pellet Sudge End Point | 16 | | 16 | | 17 | | 16 | | 16 | | 15 | |

The compositions in Tables 2–5 were formulated and the foaming properties of each were evaluated by both the cylinder test method and the pellet test method, described above. The results of these two test methods are set forth in the tables.

The deemulsification properties of compositions in Tables 2–5 were also measured. To make this measurement, the soap and soil mixture from the cylinder test (~100 ml) was transferred into a clear glass jar and kept stoppered and undisturbed for 2 weeks. The stability of emulsion formed was then followed. The milky emulsion gradually broke down, deemulsifying the mixture. The deemulsification process was rated on a scale of 1 to 5, with a rating of 1 being the most stable emulsion. This rating gives a measure of stability of the emulsion, which in turn is a measure of better performance.

These results demonstrate that the compositions according to the present invention possessed good foaming and emulsification properties. Tables 2–4 demonstrate that the performance of the compositions containing APG was better when a higher primary-to-secondary surfactant ratio was used. The results also demonstrate that improved overall foaming and emulsification properties were achieved in a composition that contained a mixed salt of dodecylbenzene sulfonate. In particular, Formula #102-81-2 and formula #102-81-5, each of which contained a magnesium/sodium mixed salt of dodecylbenzene sulfonate, achieved the best overall foaming performance. See Table 5.

TABLE 6

| Ingredients | Formula # 102-82-1 Conc. % | Formula # 102-82-1 Solids % | Formula # 102-82-2 Conc. % | Formula # 102-82-2 Solids % | Formula # 102-82-5 Conc. % | Formula # 102-82-5 Solids % | Formula # 102-82-6 Conc. % | Formula # 102-82-6 Solids % |
|---|---|---|---|---|---|---|---|---|
| Water | 41.23 | 0 | 41.79 | 0 | 40.9 | 0 | 38.55 | 0 |
| Dodecyl Benzene Sulfonic Acid (Biosoft S-100) | 25.16 | 25.16 | 22 | 22 | 25 | 25 | 25 | 25 |
| Magnesium Oxide | 1.61 | 1.61 | 1.41 | 1.41 | 1.6 | 1.6 | 0.8 | 0.8 |
| Sodium Hydroxide (50%) | 0 | 0 | 0 | 0 | 0 | 0 | 3.15 | 1.575 |
| Lauramide/Myristamide MEA (Ninol NMP) | 4 | 4 | 4 | 4 | 4 | 4 | 4 | 4 |
| Alkyl Poly Glucoside (Glucopon 625 FE) | 0 | 0 | 0 | 0 | 12.5 | 5 | 12.5 | 5 |
| α-Sulfomethyl Ester (α Step MC 48) | 17 | 6.29 | 19.8 | 7.326 | 0 | 0 | 0 | 0 |
| Alcohol Ether Sulfate - 2EO (Texapon NC 70) | 6 | 4.2 | 6 | 4.2 | 8 | 5.6 | 8 | 5.6 |
| Sodium Xylene Sulfonate (40%) | 0 | 0 | 0 | 0 | 5 | 2 | 5 | 2 |
| Ethanol (SDA-3A) | 5 | 5 | 5 | 5 | 3 | 3 | 3 | 3 |
| | 100 | 46.26 | 100 | 43.936 | 100 | 46.2 | 100 | 46.975 |
| Properties | | | | | | | | |
| Ma:Na in LAS (Mole Ratio) | Mg(1) | | Mg(1) | | Mg(1) | | (1:1) | |
| LAS:APG (Solids Content Weight Ratio) | | | | | 5:1 | | 5:1 | |
| LAS:SME (Solids Content Weight Ratio) | 4:1 | | 3:1 | | | | | |
| Primary:Secondary (Solids Content Weight Ratio) | 4.7:1 | | 3.6:1 | | 6.1:1 | | 6.1:1 | |
| Foam Height - Initial, mL | 520 | | 530 | | 455 | | 500 | |
| Foam Height with Soil, mL (Emulsification rating) | 500(+1) | | 450(+2) | | 405(+1) | | 420(=) | |
| Foam Height - Regeneration, mL | 500 | | 435 | | 405 | | 420 | |
| Foam Height, mL (Emulsification rating) | | | | | | | | |
| 10 Drops Oil | 250 | | 255 | | 225 | | 300 | |
| 50 Drops Oil | 240 | | 235 | | 220 | | 255 | |
| 100 Drops Oil | 210 (=) | | 220 (=/−) | | 195 (=) | | 200 (=/−) | |
| 150 Drops Oil | 180 (=) | | 170 (=) | | 160 (=) | | 150 (−2) | |
| 175 Drops Oil | 165 (=) | | 155 (=) | | 150 (=) | | 130 (=/−) | |
| 200 Drops Oil | 150 (=) | | 135 (=/−) | | 145 (=) | | 125 (=/−) | |
| 210 Drops Oil | 145 (=) | | 125 (=/−) | | 135 (=) | | 125 (=/−) | |
| 220 Drops Oil | 125 (=) | | 120 (=/−) | | 125 (=) | | 120 (=/−) | |
| 230 Drops Oil | 125 (=) | | 120 (−) | | 125 (=) | | 125 (−2) | |
| 240 Drops Oil | 125 (=) | | worst | | 125 (=) | | worst | |
| 250 Drops Oil | 125 (=) | | worst | | 125 (=) | | worst | |
| Pellet Sudge End Point | 15/16 | | 15 | | 17 | | 17 | |

TABLE 7

| Ingredients | Formula # 102-82-1 Conc. % | Formula # 102-82-1 Solids % | Formula # 102-82-5 Conc. % | Formula # 102-82-5 Solids % | Formula # 102-81-2 Conc. % | Formula # 102-81-2 Solids % | Premium Commercial Product A Conc. % | Premium Commercial Product A Solids % |
|---|---|---|---|---|---|---|---|---|
| Water | 41.23 | 0 | 40.9 | 0 | 38.05 | 0 | 17 | 0 |
| Dodecyl Benzene Sulfonic Acid (Biosoft S-100) | 25.16 | 25.16 | 25 | 25 | 25 | 25 | 0 | 0 |
| Magnesium Oxide | 1.61 | 1.61 | 1.6 | 1.6 | 0.8 | 0 | 0 | 0 |
| Sodium Hydroxide (50%) | 0 | 0 | 0 | 0 | 3.15 | 1.575 | 0 | 0 |
| Lauramide/Myristamide MEA (Ninol NMP) | 4 | 4 | 4 | 4 | 4 | 4 | 0 | 0 |
| Alkyl Poly Glucoside (Glucopon 625 FE) | 0 | 0 | 12.5 | 5 | 15 | 6 | 0 | 0 |
| Alkyl Glucosamide-P & G Prop. | 0 | 0 | 0 | 0 | 0 | 0 | 6 | 6 |
| Coco APAO-Standamox CA | 0 | 0 | 0 | 0 | 0 | 0 | 20 | 6 |
| Ethoxylated Alcohol (Neodol 1-9) | 0 | 0 | 0 | 0 | 0 | 0 | 5 | 5 |
| Magnesium Chloride | 0 | 0 | 0 | 0 | 0 | 0 | 2 | 2 |
| α-Sulfomethyl Ester (α Step MC 48) | 17 | 6.29 | 0 | 0 | 0 | 0 | 0 | 0 |
| Alcohol Ether Sulfate - 2EO (Texapon NC 70) | 6 | 4.2 | 8 | 5.6 | 6 | 4.2 | 40 | 28 |
| Sodium Xylene Sulfonate (40%) | 0 | 0 | 5 | 2 | 5 | 2 | 5 | 2 |
| Ethanol (SDA-3A) | 5 | 5 | 3 | 3 | 3 | 3 | 5 | 5 |
| | 100 | 46.26 | 100 | 46.2 | 100 | 45.775 | 100 | 54 |
| Properties | | | | | | | | |
| Ma:Na In LAS (Mole Ratio) | Mg(1) | | Mg(1) | | 1:1 | | n/a | |
| LAS:APG (Solids Content Weight Ratio) | | | 5:1 | | 4:1 | | n/a | |
| LAS:SME (Solids Content Weight Ratio) | 4:1 | | | | | | n/a | |
| Primary:Secondary (Solids Content Weight Ratio) | 4.7:1 | | 6.1:1 | | 4.9:1 | | n/a | |
| Foam Height - Initial, mL | 535 | | 465 | | 600 | | 375 | |

TABLE 7-continued

| Ingredients | Formula # 102-82-1 Conc. % | Formula # 102-82-1 Solids % | Formula # 102-82-5 Conc. % | Formula # 102-82-5 Solids % | Formula # 102-81-2 Conc. % | Formula # 102-81-2 Solids % | Premium Commercial Product A Conc. % | Premium Commercial Product A Solids % |
|---|---|---|---|---|---|---|---|---|
| Foam Height with Soil, mL (Emulsification rating) | 440 (=) | | 375 (=) | | 425 (=) | | 300 (=) | |
| Foam Height - Regeneration. mL | 375 | | 325 | | 375 | | 275 | |
| Foam Height, mL (Emulsification rating) | | | | | | | | |
| 10 Drops Oil | 440 | | 375 | | 425 | | 300 | |
| 50 Drops Oil | 340 | | 290 | | 350 | | 145 | |
| 100 Drops Oil | 300 | | 265 | | 300 | | 115 | |
| 125 Drops Oil | 275 | | 225 | | 280 | | 120 | |
| 150 Drops Oil | 260 (=) | | 215 (=/−) | | 250 (=) | | 120 (=) | |
| 175 Drops Oil | 250 | | 200 | | 250 | | 130 | |
| 200 Drops Oil | 240 (=) | | 180 (=) | | 250 (=) | | 130 (=) | |
| 210 Drops Oil | 210 (=) | | 150 (=/−) | | 210 (=) | | 135 (=) | |
| 225 Drops Oil | 190 (=) | | 140 (=/−) | | 200 (=) | | 130 (=) | |
| 235 Drops Oil | 215 | | 140 | | 125 (=) | | 140 (=) | |
| 250 Drops Oil | 200 (=) | | 125 (−) | | 175 (=/−) | | 125 (=) | |
| 300 Drops Oil | 180 (best) | | 130 (worse) | | 150 (better) | | 125 (good) | |
| Pellet Sudge End Point | 16/17 | | 17 | | 16/17 | | 20/21 | |

TABLE 8

| Ingredients | Formula # 102-84-1 Conc. % | Formula # 102-84-1 Solids % | Formula # 102-84-2 Conc. % | Formula # 102-84-2 Solids % | Formula # 102-84-3 Conc. % | Formula # 102-84-3 Solids % | Formula # 102-84-4 Conc. % | Formula # 102-84-4 Solids % | Formula # 102-84-5 Conc. % | Formula # 102-84-5 Solids % | Formula # 102-84-6 Conc. % | Formula # 102-84-6 Solids % |
|---|---|---|---|---|---|---|---|---|---|---|---|---|
| Water | 41.35 | 0 | 41.35 | 0 | — | 0 | — | 0 | — | 0 | 39.85 | 0 |
| Dodecyl Benzene Sulfonic Acid (Biosoft S-100) | 18 | 18 | 18 | 18 | 18 | 18 | 21 | 21 | 21 | 21 | 21 | 21 |
| Magnesium Oxide | 0.6 | 0.6 | 0.6 | 0.6 | 0.6 | 0.6 | 0.7 | 0.7 | 0.7 | 0.7 | 0.7 | 0.7 |
| Sodium Hydroxide (50%) | 2.4 | 1.2 | 2.4 | 1.2 | 2.4 | 1.2 | 2.8 | 1.4 | 2.8 | 1.4 | 2.8 | 1.4 |
| Lauramide/Myristamide MEA (Ninol NMP) | 4 | 4 | 4 | 4 | 4 | 4 | 4 | 4 | 4 | 4 | 4 | 4 |
| Ethoxylated Alcohol (Neodol 1-9) | 4 | 4 | 2 | 2 | 0 | 0 | 4 | 4 | 2 | 2 | 0 | 0 |
| Alkyl Poly Glucoside (Glucopon 625 FE) | 15 | 6 | 15 | 6 | 15 | 6 | 15 | 6 | 15 | 6 | 15 | 6 |
| Alcohol Ether Sulfate - 2EO (Texapon NC 70) | 9.5 | 6.65 | 11.5 | 8.05 | 13.5 | 9.45 | 7.5 | 5.25 | 9.5 | 6.65 | 11.5 | 8.05 |
| Ethanol (SDA-3A) | 5 | 5 | 5 | 5 | 5 | 5 | 5 | 5 | 5 | 5 | 5 | 5 |
| Perfume (SZ4071) | 0.15 | 0.15 | 0.15 | 0.15 | 0.15 | 0.15 | 0.15 | 0.15 | 0.15 | 0.15 | 0.15 | 0.15 |
| | 100 | 45.6 | 100 | 45 | 100 | 44.4 | 100 | 47.5 | 100 | 46.9 | 100 | 46.3 |
| Properties | | | | | | | | | | | | |
| Mg:Na in LAS (Mole Ratio) | Mg:Na (1:1) | | Mg:Na (1:1) | | Mg:Na (1:1) | | Mg:Na (1:1) | | Mg:Na (1:1) | | Mg:Na (1:1) | |
| LAS:APG (Solids Content Weight Ratio) | 3:1 | | 3:1 | | 3:1 | | 3.5:1 | | 3.5:1 | | 3.5:1 | |
| AES:APG (Solids Content Weight Ratio) | 1.1:1 | | 1.3:1 | | 1.6:1 | | 0.9:1 | | 1.1:1 | | 1.3:1 | |
| Primary:Secondary (Solids Content Weight Ratio) | 4.1:1 | | 4.3:1 | | 4.6:1 | | 4.4:1 | | 4.6:1 | | 4.8:1 | |
| Foam Height - Initial, mL | 500 | | 505 | | 500 | | 560 | | 550 | | 505 | |
| Foam Height with Soil, mL (Emulsification rating) | 420 (=) | | 450 (=) | | 420 (=) | | 450 (=) | | 480 (=) | | 465 (=) | |
| Foam Height - Regeneration, mL | 320 (=) | | 330 (=) | | 370 (=) | | 290 (=) | | 365 (=) | | 370 = | |
| Foam Height, mL (Emulsification rating) | | | | | | | | | | | | |
| 0 Drops Oil | 420 (=) | | 450 (=) | | 420 (=) | | 450 (=) | | 480 (=) | | 465 (=) | |
| 50 Drops Oil | 220 (=) | | 225 (=) | | 245 (=) | | 205 (=) | | 250 (=) | | 250 (=) | |
| 100 Drops Oil | 165 (=) | | 185 (=) | | 205 (=) | | 160 =/+ | | 200 (=) | | 190 (=) | |
| 125 Drops Oil | 150 (=) | | 200 (=) | | 210 (=) | | 145 (=) | | 215 (=) | | 190 (=/+) | |
| 150 Drops Oil | 150 (=) | | 185 (=) | | 200 (=) | | 130 (=) | | 185 (=) | | 190 (=/+) | |
| 175 Drops Oil | 150 (=) | | 175 (=/+) | | 185 (=) | | 125 (=) | | 175 (=) | | 175 (=) | |
| 200 Drops Oil | 150 (−) | | 160 (=) | | 175 (=/+) | | 130 (=/−) | | 160 (=) | | 175 (=) | |
| 225 Drops Oil | 135 (−) | | 150 (−) | | 150 (−) | | 130 (=) | | 150 (=) | | 150 (+) | |
| 235 Drops Oil | 130 (−2) | | 140 (−2) | | 140 (−) | | 125 (=) | | 135 (=) | | 140 (+) | |
| 250 Drops Oil | 130 (−2) | | 140 (−2) | | 145 (−2) | | 125 (−) | | 130 (=) | | 145 (+) | |

TABLE 8-continued

| Ingredients | Formula # 102-84-1 Conc. % | Formula # 102-84-1 Solids % | Formula # 102-84-2 Conc. % | Formula # 102-84-2 Solids % | Formula # 102-84-3 Conc. % | Formula # 102-84-3 Solids % | Formula # 102-84-4 Conc. % | Formula # 102-84-4 Solids % | Formula # 102-84-5 Conc. % | Formula # 102-84-5 Solids % | Formula # 102-84-6 Conc. % | Formula # 102-84-6 Solids % |
|---|---|---|---|---|---|---|---|---|---|---|---|---|
| 300 Drops Oil | 125 (−2) | | 130 (−1) | | 130 (−3) worst | | 125 (+1) | | 130 (=) | | 130 (+2) best | |
| Pellet Sudge End Point | 15 | | 15 | | 14 | | 14 | | 14 | | 15 | |

TABLE 9

| Ingredients | Formula # 102-85-1 Conc. % | Formula # 102-85-1 Solids % | Formula # 102-85-2 Conc. % | Formula # 102-85-2 Solids % | Formula # 102-85-3 Conc. % | Formula # 102-85-3 Solids % | Formula # 102-85-4 Conc. % | Formula # 102-85-4 Solids % | Formula # 102-85-5 Conc. % | Formula # 102-85-5 Solids % | Formula # 102-85-6 Conc. % | Formula # 102-85-6 Solids % |
|---|---|---|---|---|---|---|---|---|---|---|---|---|
| Water | 44.93 | 0 | 44.93 | 0 | 44.93 | 0 | 44.23 | 0 | 44.23 | 0 | 44.23 | 0 |
| Dodecyl Benzene Sulfonic Acid (Biosoft S-100) | 18 | 18 | 18 | 18 | 18 | 18 | 21 | 21 | 21 | 21 | 21 | 21 |
| Magnesium Oxide | 1.2 | 1.2 | 1.2 | 1.2 | 1.2 | 1.2 | 1.4 | 1.4 | 1.4 | 1.4 | 1.4 | 1.4 |
| Lauramide/Myristamide MEA (Ninol NMP) | 4 | 4 | 4 | 4 | 4 | 4 | 4 | 4 | 4 | 4 | 4 | 4 |
| Ethoxylated Alcohol (Neodol 1-9) | 4 | 4 | 2 | 2 | 0 | 0 | 4 | 4 | 2 | 2 | 0 | 0 |
| α-Sulfomethyl Ester (α Step MC 48) | 16.22 | 6.0014 | 16.22 | 6.0014 | 16.22 | 6.0014 | 16.22 | 6.0014 | 16.22 | 6.0014 | 16.22 | 6.0014 |
| Alcohol Ether Sulfate - 2EO (Texapon NC 70) | 6.5 | 4.55 | 8.5 | 5.95 | 10.5 | 7.35 | 5 | 3.5 | 7 | 4.9 | 9 | 6.3 |
| Ethanol (SDA-3A) | 5 | 5 | 5 | 5 | 5 | 5 | 4 | 4 | 4 | 4 | 4 | 4 |
| Perfume (SZ4071) | 0.15 | 0.15 | 0.15 | 0.15 | 0.15 | 0.15 | 0.15 | 0.15 | 0.15 | 0.15 | 0.15 | 0.15 |
| | 100 | 42.9014 | 100 | 42.3014 | 100 | 41.7014 | 100 | 44.0514 | 100 | 43.4514 | 100 | 42.851 |
| Properties | | | | | | | | | | | | |
| Mg:Na in LAS (Mole Ratio) | Mg(1) | | Mg(1) | | Mg(1) | | Mg(1) | | Mg(1) | | Mg(1) | |
| LAS:SME (Solids Content Weight Ratio) | 3:1 | | 3:1 | | 3:1 | | 3.5:1 | | 3.5:1 | | 3.5:1 | |
| AES:SME (Solids Content Weight Ratio) | 0.8:1 | | 1:1 | | 1.2:1 | | 0.6:1 | | 0.8:1 | | 1.11 | |
| Primary:Secondary (Solids Content Weight Ratio) | 3.8:1 | | 4:1 | | 4.2:1 | | 4.1:1 | | 4.3:1 | | 4.6:1 | |
| Foam Height - Initial, mL | 550 | | 540 | | 550 | | 500 | | 550 | | 570 | |
| Foam Height with Soil, mL (Emulsification rating) | 350 (=) | | 380 (+) | | 420 (=) | | 380 (=) | | 425 (=) | | 445 (=) | |
| Foam Height - Regeneration, mL | 305 | | 325 | | 385 | | 285 | | 330 | | 360 | |
| Foam Height, mL (Emulsification rating) | | | | | | | | | | | | |
| 0 Drops Oil | 350 (=) | | 380 (+) | | 420 (=) | | 380 (=) | | 425 (=) | | 445 (=) | |
| 50 Drops Oil | 155 (=) | | 200 (=) | | 230 (+) | | 185 (=) | | 240 (=) | | 225 (+) | |
| 100 Drops Oil | 160 (+) | | 155 (+) | | 170 (+) | | 160 (=) | | 210 (=) | | 210 (+) | |
| 125 Drops Oil | 155 (+) | | 150 (+) | | 155 (=) | | 150 (−) | | 195 (−) | | 205 (=) | |
| 150 Drops Oil | 140 (=) | | 140 (+) | | 135 (=) | | 135 (−) | | 180 (=) | | 190 (=) | |
| 175 Drops Oil | 150 (=) | | 145 (+) | | 140 (+) | | 135 (−) | | 170 (=) | | 175 (=) | |
| 200 Drops Oil | 150 (=) | | 140 (=/+) | | 135 (=/+) | | 140 (−) | | 175 (=/−) | | 175 (=) | |
| 225 Drops Oil | 135 (=/+) | | 135 (+) | | 125 (=/+) | | 130 (−2) | | 150 (=) | | 145 (=/+) | |
| 235 Drops Oil | 125 (=) | | 130 (+) | | 125 (=) | | 130 (−2) | | 140 (−2) | | 135 (=/−) | |
| 250 Drops Oil | 125 (+) | | 125 (+) | | 125 (=) | | 125 (−2) | | 125 (=) | | 125 (=) | |
| 300 Drops Oil | 125 (−1) | | 125 (+2) best | | 125 (=) | | 125 (−3) worst | | 125 (−2) | | 125 (+1) | |
| Pellet Sudge End Point | 14 | | 14 | | 14 | | 14 | | 15 | | 15 | |

TABLE 10

| Ingredients | Formula # 102-87-1 Conc. % | Formula # 102-87-1 Solids % | Formula # 102-87-2 Conc. % | Formula # 102-87-2 Solids % | Formula # 102-87-3 Conc. % | Formula # 102-87-3 Solids % | Formula # 102-87-4 Conc. % | Formula # 102-87-4 Solids % | Formula # 102-87-5 Conc. % | Formula # 102-87-5 Solids % | Formula # 102-87-6 Conc. % | Formula # 102-87-6 Solids % |
|---|---|---|---|---|---|---|---|---|---|---|---|---|
| Water | 37.97 | 0 | 39.46 | 0 | 40.33 | 0 | 39.07 | 0 | 39.83 | 0 | 40.48 | 0 |
| Dodecyl Benzene Sulphonic Acid (Biosoft S-100) | 24 | 24 | 21 | 21 | 18.32 | 18.32 | 24 | 24 | 21 | 21 | 18.32 | 18.32 |
| Magnesium Oxide | 1.05 | 1.05 | 0.92 | 0.92 | 0.8 | 0.8 | 2.11 | 2.11 | 1.85 | 1.85 | 1.6 | 1.6 |
| Sodium Hydroxide (50%) | 2.88 | 1.44 | 2.52 | 1.28 | 2.2 | 1.1 | 0 | 0 | 0 | 0 | 0 | 0 |

TABLE 10-continued

| Ingredients | Formula # 102-87-1 Conc. % | Formula # 102-87-1 Solids % | Formula # 102-87-2 Conc. % | Formula # 102-87-2 Solids % | Formula # 102-87-3 Conc. % | Formula # 102-87-3 Solids % | Formula # 102-87-4 Conc. % | Formula # 102-87-4 Solids % | Formula # 102-87-5 Conc. % | Formula # 102-87-5 Solids % | Formula # 102-87-6 Conc. % | Formula # 102-87-6 Solids % |
|---|---|---|---|---|---|---|---|---|---|---|---|---|
| Lauramide/Myristamide MEA (Ninol NMP) | 4 | 4 | 4 | 4 | 4 | 4 | 4 | 4 | 4 | 4 | 4 | 4 |
| Ethoxylated Alcohol (Neodol 1-9) | 0 | 0 | 0 | 0 | 2 | 2 | 0 | 0 | 2 | 2 | 2 | 2 |
| Alkyl Poly Glucoside (Glucopon 625 FE) | 15 | 6 | 15 | 6 | 15.25 | 6.1 | 0 | 0 | 0 | 0 | 0 | 0 |
| α-Sulfomethyl Ester (α Step MC 48) | 0 | 0 | 0 | 0 | 0 | 0 | 16.22 | 6.0014 | 16.22 | 6.0014 | 16.5 | 6.105 |
| Alcohol Ether Sulfate - 2EO (Texapon NC 70) | 6 | 4.2 | 8 | 5.6 | 8 | 5.6 | 6 | 4.2 | 6 | 4.2 | 8 | 5.6 |
| Amphoteric-Miranol Ultra C-39 | 4 | 1.52 | 4 | 1.52 | 4 | 1.52 | 4 | 1.52 | 4 | 1.52 | 4 | 1.52 |
| Ethanol (SDA-3A) | 5 | 5 | 5 | 5 | 5 | 5 | 4.5 | 4.5 | 5 | 5 | 5 | 5 |
| Perfume (SZ4071) | 0.1 | 0.1 | 0.1 | 0.1 | 0.1 | 0.1 | 0.1 | 0.1 | 0.1 | 0.1 | 0.1 | 0.1 |
| | 100 | 47.31 | 100 | 45.4 | 100 | 44.54 | 100 | 46.43 | 100 | 45.6714 | 100 | 44.245 |
| Properties | | | | | | | | | | | | |
| Mg:Na in LAS (Mole Ratio) | 1:1 | | 1:1 | | 1:1 | | Mg(1) | | Mg(1) | | Mg(1) | |
| LAS:APG/SME (Solids Content Weight Ratio) | 4:1 (APG) | | 3.5:1 (APG) | | 3:1 (APG) | | 4:1 (SME) | | 3.5:1 (SME) | | 3:1 (SME) | |
| AES:APG/SME (Solids Content Weight Ratio) | 0.7:1 (APG) | | 0.9:1 (APG) | | 0.9:1 (APG) | | 0.7:1 (SME) | | 0.7:1 (SME) | | 0.9:1(SME) | |
| Primary:Secondary (Solids Content Weight Ratio) | 4.7:1 | | 4.4:1 | | 3.9:1 | | 4.7:1 | | 4.2:1 | | 3.9:1 | |
| Foam Height - Initial, mL | 505 | | 500 | | 500 | | 495 | | 525 | | 510 | |
| Foam Height with Soil, mL (Emulsification rating) | 455 (=) | | 455 (=) | | 395 (=) | | 410 (=) | | 450 (=) | | 395 (=) | |
| Foam Height - Regeneration, mL | 400 | | 380 | | 285 | | 280 | | 300 | | 305 | |
| Foam Height, mL (Emulsification rating) | | | | | | | | | | | | |
| 10 Drops Oil | 455 (=) | | 455 (=) | | 395 (=) | | 410 (=) | | 450 (=) | | 395 (=) | |
| 50 Drops Oil | 200 (+1.5) | | 260 (+1) | | 230 (=) | | 200 (=) | | 200 (=) | | 175 (=/+) | |
| 100 Drops Oil | 190 (+1) | | 230 (+1) | | 200 (=) | | 140 (=) | | 135 (=) | | 135 (=/+) | |
| 125 Drops Oil | 170 (+1.5) | | 205 (=/+) | | 120 (=) | | 125 (=) | | 130 (=) | | 130 (+1) | |
| 150 Drops Oil | 150 (+2) | | 170 (+1) | | 140 (=) | | 130 (=/−) | | 130 (=) | | 140 (+1.5) | |
| 175 Drops Oil | 150 (+1.5) | | 155 (+1) | | 130 (=) | | 125 (−) | | 130 (=) | | 135 (+1.5) | |
| 200 Drops Oil | 130 (+2) | | 140 (+1) | | 125 (=) | | 125 (−) | | 130 (=) | | 125 (+1.5) | |
| 225 Drops Oil | 125 (+1) | | 125 (+1.5) | | 125 (=) | | 125 (−) | | 130 (=) | | 125 (+1) | |
| 235 Drops Oil | 125 (+1) | | 130 (+1.5) | | 125 (=) | | 125 (−) | | 125 (=) | | 125 (+1) | |
| 250 Drops Oil | 125 (+1) | | 130 (+1.5) | | 125 (=) | | 125 (−) | | 125 (=) | | 125 (+1) | |
| 300 Drops Oil | 125 (+1) | | 130 (+2) | | 125 (=) | | 125 (−1) | | 125 (−1) | | 125 (+1) | |
| Pellet Sudge End Point | 15 | | 15 | | 15 | | 15 | | 15 | | 15 | |

In Tables 6, 7, 8, 9, and 10, the compositions were formulated and the foaming properties of each were evaluated by both the cylinder test method and the pellet test method, described above. The results of these two test methods are set forth in the tables.

Additionally, the grease emulsification was tested. In this test, a number of drops of oil, as set forth in the tables, were added to each composition. The foam height was measured, and each emulsion was graded according to the following scale:

= standard;

=/− slightly worse than standard;

=/+ slightly better than standard;

+ better than standard;

+1 much better than standard;

+2 much much better than standard;

+3 significantly better than standard;

−1 much worse than standard;

−2 much much worse than standard; etc.

The grading, listed in the tables as "(Emulsification rating)," is recited in parenthesis after the recorded foam height values.

Table 6 demonstrates that a composition containing an SME surfactant gave much better performance in emulsification when a lower primary-to-surfactant ratio was used. Table 7 demonstrates that better performance in foam generation, foam stability and emulsification was achieved in an SME surfactant-containing composition in which a lower primary-to-secondary surfactant ratio was employed.

Table 8 shows that a higher primary-to-secondary surfactant ratio in a composition containing an APG surfactant gave better performance in emulsification. This table also shows that a composition comprising ethoxylated alcohol and an alcohol ether sulfate performed better than a composition comprising the alcohol ether sulfate but no ethoxylated alcohol.

Table 9 demonstrates that, in a composition comprising an SME surfactant, a lower primary-to-secondary surfactant ratio resulted in better performance. Additionally, the table demonstrates that a composition comprising ethoxylated alcohol in addition to an ethoxylated alcohol ether sulfate performed better than a composition comprising only an ethoxylated alcohol ether sulfate (see formula number 102-85-4 and formula number 102-85-6).

Tables 11–15 that follow contain various formulations within the scope of the present invention. In these compositions, the concentration and identity of the individual components in the detergent composition were varied in order to produce compositions having different Mg:Na mole ratios, different LAS:APG/SME ratios, different AES:APG/SME ratios, and different primary:secondary surfactant ratios.

TABLE 11

| | Formula # 102-86-1 | | Formula # 102-86-2 | |
|---|---|---|---|---|
| Ingredients | Conc. % | Solids % | Conc. % | Solids % |
| Water | 59.015 | 0 | 58.585 | 0 |
| Dodecyl Benzene Sulphonic Acid (Biosoft S-100) | 19.12 | 19.12 | 19.13 | 19.13 |
| Magnesium Oxide | 1.22 | 1.22 | 0.61 | 0.61 |
| Sodium Hydroxide (50%) | 0 | 0 | 2.41 | 1.205 |
| Lauramide/Myristamide MEA (Ninol NMP) | 3.04 | 3.04 | 3.06 | 3.06 |
| Alkyl Poly Glucoside (Glucopon 625 FE) | 0 | 0 | 11.48 | 4.592 |
| α-Sulfomethyl Ester (α Step MC 48) | 12.92 | 4.7804 | 0 | 0 |
| Alcohol Ether Sulfate - 2EO (Texapon NC 70) | 4.56 | 3.192 | 4.6 | 3.22 |
| Ucarcide 250 | 0.02 | 0.01 | 0.02 | 0.01 |
| Dye, Resorcin Brown | 0.005 | 0.005 | 0.005 | 0.005 |
| Lemon Perfume SZ6152 | 0.1 | 0.1 | 0.1 | 0.1 |
| | 100 | 31.4674 | 100 | 31.932 |
| Properties | | | | |
| Mg:Na in LAS (Mole Ratio) | Mg(1) | | 1:1 | |
| LAS:APG/SME (Solids Content Weight Ratio) | 4:1 (SME) | | 4.1:1 (APG) | |
| AES:APG/SME (Solids Content Weight Ratio) | 0.7:1 (SME) | | 0.7:1 (APG) | |
| Primary:Secondary (Solids Content Weight Ratio) | 4.7 :1 | | 4.8:1 | |

TABLE 12

| | Formula # 102-88-1 | | Formula # 102-88-2 | | Formula # 102-88-3 | | Formula # 102-88-4 | | Formula # 102-88-5 | | Formula # 102-88-6 | |
|---|---|---|---|---|---|---|---|---|---|---|---|---|
| Ingredients | Conc. % | Solids % | Conc. % | Solids % | Conc. % | Solids % | Conc. % | Solids % | Conc. % | Solids % | Conc. % | Solids % |
| Water | 35.4 | 0 | 37.2 | 0 | 38.2 | 0 | 39.2 | 0 | 40.2 | 0 | 36.2 | 0 |
| Dodecyl Benzene Sulphonic Acid (Biosoft S-100) | 21 | 21 | 21 | 21 | 21 | 21 | 21 | 21 | 21 | 21 | 21 | 21 |
| Magnesium Oxide | 0.8 | 0.8 | 0.8 | 0.8 | 0.8 | 0.8 | 0.8 | 0.8 | 0.8 | 0.8 | 0.8 | 0.8 |
| Sodium Hydroxide (50%) | 2.4 | 1.2 | 2.4 | 1.2 | 2.4 | 1.2 | 2.4 | 1.2 | 2.4 | 1.2 | 2.4 | 1.2 |
| Lauramide/Myristamide MEA (Ninol NMP) | 4 | 4 | 4 | 4 | 4 | 4 | 4 | 4 | 4 | 4 | 4 | 4 |
| Alkyl Poly Glucoside (Glucopon 625 FE) | 15 | 6 | 15 | 6 | 15 | 6 | 15 | 6 | 15 | 6 | 15 | 6 |
| Alcohol Ether Sulfate - 2EO (Texapon NC 70) | 8 | 5.6 | 8 | 5.6 | 8 | 5.6 | 8 | 5.6 | 8 | 5.6 | 8 | 5.6 |
| Sodium Lauroamphoacetate (Miranol HMA) | 4 | 1.28 | 3 | 0.96 | 2 | 0.64 | 1 | 0.32 | 0 | 0 | 0 | 0 |
| Amphoteric-Miranol Ultra C-32 | 0 | 0 | 0 | 0 | 0 | 0 | 0 | 0 | 0 | 0 | 4 | 1.28 |
| Sodium Xylene Sulfonate (40%) | 7 | 2.8 | 6 | 2.4 | 6 | 2.4 | 6 | 2.4 | 6 | 2.4 | 6 | 2.4 |
| Ethanol (SDA-3A) | 3 | 3 | 2.5 | 2.5 | 2.5 | 2.5 | 2.5 | 2.5 | 2.5 | 2.5 | 2.5 | 2.5 |
| Perfume (SZ4071) | 0.3 | 0.3 | 0.1 | 0.1 | 0.1 | 0.1 | 0.1 | 0.1 | 0.1 | 0.1 | 0.1 | 0.1 |
| | 100 | 45.98 | 100 | 44.56 | 100 | 44.24 | 100 | 43.92 | 100 | 43.6 | 100 | 44.88 |
| Properties | | | | | | | | | | | | |
| Mg:Na in LAS (Mole Ratio) | 1:1 | | 1:1 | | 1:1 | | 1:1 | | 1:1 | | 1:1 | |
| LAS:APG (Solids Content Weight Ratio) | 3.5:1 | | 3.5:1 | | 3.5:1 | | 3.5:1 | | 3.5:1 | | 3.5:1 | |
| AES:APG (Solids Content Weight Ratio) | 0.9:1 | | 0.9:1 | | 0.9:1 | | 0.9:1 | | 0.9:1 | | 0.9:1 | |
| Primary:Secondary (Solids Content Weight Ratio) | 4.4:1 | | 4.4:1 | | 4.4:1 | | 4.4:1 | | 4.4:1 | | 4.4:1 | |

TABLE 13

| | Formula # 102-89-1 | | Formula # 102-89-2 | | Formula # 102-89-3 | | Formula # 102-89-4 | | Formula # 102-89-5 | |
|---|---|---|---|---|---|---|---|---|---|---|
| Ingredients | Conc. % | Solids % | Conc. % | Solids % | Conc. % | Solids % | Conc. % | Solids % | Conc. % | Solids % |
| Water | 34.875 | 0 | 35.074 | 0 | 35.074 | 0 | 35.074 | 0 | 35.574 | 0 |
| Magnesium Oxide | 0.8 | 0.8 | 0.8 | 0.8 | 0.8 | 0.8 | 0.8 | 0.8 | 0.8 | 0.8 |

TABLE 13-continued

| | | | | | | | | | | |
|---|---|---|---|---|---|---|---|---|---|---|
| Dodecyl Benzene Sulfonic Acid (Biosoft S-100) | 21 | 21 | 21 | 21 | 21 | 21 | 21 | 21 | 21 | 21 |
| Sodium Hydroxide (50%) | 2.4 | 1.2 | 2.4 | 1.2 | 2.4 | 1.2 | 2.4 | 1.2 | 2.4 | 1.2 |
| Lauramide/Myristamide MEA (Ninol NMP) | 4 | 4 | 4 | 4 | 4 | 4 | 4 | 4 | 4 | 4 |
| Ethanol-SDA 3A | 3 | 3 | 3 | 3 | 2 | 2 | 1 | 1 | 5 | 5 |
| Propylene Glycol | 0 | 0 | 0 | 0 | 0 | 0 | 0 | 0 | 1 | 1 |
| Alkyl Poly Glucoside (Glucopon 625 FE) | 15 | 6 | 15 | 6 | 15 | 6 | 15 | 6 | 15 | 6 |
| Alcohol Ether Sulfate - 2EO (Texapon NC 70) | 8 | 5.6 | 8 | 5.6 | 8 | 5.6 | 8 | 5.6 | 8 | 5.6 |
| Sodium Lauroamphoacetate (Miranol HMA) | 4 | 1.24 | 3.5 | 1.085 | 3.5 | 1.085 | 3.5 | 1.085 | 4 | 1.24 |
| Sodium Xylene Sulfonate (40%) | 6.5 | 2.6 | 7 | 2.8 | 8 | 3.2 | 9 | 3.6 | 3 | 1.2 |
| Ucarcide 250 | 0.02 | 0.01 | 0.02 | 0.01 | 0.02 | 0.01 | 0.02 | 0.01 | 0.02 | 0.01 |
| Dye, FD & C Blue #1 | 0 | 0 | 0.0015 | 0.0015 | 0.0015 | 0.0015 | 0.0015 | 0.0015 | 0.0015 | 0.0015 |
| Dye, Acid Yellow 23 | 0.005 | 0.005 | 0.0045 | 0.0045 | 0.0045 | 0.0045 | 0.0045 | 0.0045 | 0.0045 | 0.0045 |
| Perfume SZ6152 | 0.4 | 0.4 | 0.2 | 0.2 | 0.2 | 0.08 | 0.2 | 0.2 | 0.2 | 0.2 |
| | 100 | 45.855 | 100 | 45.701 | 100 | 44.981 | 100 | 44.501 | 100 | 47.256 |
| Properties | | | | | | | | | | |
| Mg:Na in LAS (Mole Ratio) | 1:1 | | 1:1 | | 1:1 | | 1:1 | | 1:1 | |
| LAS:APG (Solids Content Weight Ratio) | 3.5:1 | | 3.5:1 | | 3.5:1 | | 3.5:1 | | 3.5:1 | |
| AES:APG (Solids Content Weight Ratio) | 0.9:1 | | 0.9:1 | | 0.9:1 | | 0.9:1 | | 0.9:1 | |
| Prim:Second (Solids Content Weight Ratio) | 4.4:1 | | 4.4:1 | | 4.4:1 | | 4.4:1 | | 4.4:1 | |

| | Formula # 102-89-6 | | Formula # 102-89-7 | | Formula # 102-89-8 | | Formula # 102-89-9 | | Formula # 102-89-10 | |
|---|---|---|---|---|---|---|---|---|---|---|
| Ingredients | Conc. % | Solids % | Conc. % | Solids % | Conc. % | Solids % | Conc. % | Solids % | Conc. % | Solids % |
| Water | 35.074 | 0 | 35.074 | 0 | 39.074 | 0 | 35.074 | 0 | 36.574 | 0 |
| Magnesium Oxide | 0.8 | 0.8 | 0.8 | 0.8 | 0.8 | 0.8 | 0.8 | 0.8 | 0.8 | 0.8 |
| Dodecyl Benzene Sulfonic Acid (Biosoft S-100) | 21 | 21 | 21 | 21 | 21 | 21 | 21 | 21 | 21 | 21 |
| Sodium Hydroxide (50%) | 2.4 | 1.2 | 2.4 | 1.2 | 2.4 | 1.2 | 2.4 | 1.2 | 2.4 | 1.2 |
| Lauramide/Myristamide MEA (Ninol NMP) | 4 | 4 | 4 | 4 | 4 | 4 | 4 | 4 | 4 | 4 |
| Ethanol-SDA 3A | 5 | 5 | 6 | 6 | 5 | 5 | 6 | 6 | 6 | 6 |
| Propylene Glycol | 0 | 0 | 0 | 0 | 1 | 1 | 0 | 0 | 2 | 2 |
| Alkyl Poly Glucoside (Glucopon 625 FE) | 15 | 6 | 15 | 6 | 15 | 6 | 15 | 6 | 15 | 6 |
| Alcohol Ether Sulfate - 2EO (Texapon NC 70) | 8 | 5.6 | 8 | 5.6 | 8 | 5.6 | 8 | 5.6 | 8 | 5.6 |
| Sodium Lauroamphoacetate (Miranol HMA) | 3.5 | 1.085 | 3.5 | 1.085 | 3.5 | 1.085 | 3.5 | 1.085 | 4 | 1.24 |
| Sodium Xylene Sulfonate (40%) | 5 | 2 | 4 | 1.6 | 0 | 0 | 4 | 1.6 | 0 | 0 |
| Ucarcide 250 | 0.02 | 0.01 | 0.02 | 0.01 | 0.02 | 0.01 | 0.02 | 0.01 | 0.02 | 0.01 |
| Dye, FD & C Blue #1 | 0.0015 | 0.0015 | 0.0015 | 0.0015 | 0.0015 | 0.0015 | 0.0015 | 0.0015 | 0.0015 | 0.0015 |
| Dye, Acid Yellow 23 | 0.0045 | 0.0045 | 0.0045 | 0.0045 | 0.0045 | 0.0045 | 0.0045 | 0.0045 | 0.0045 | 0.0045 |
| Perfume SZ6152 | 0.2 | 0.2 | 0.2 | 0.2 | 0.2 | 0.2 | 0.2 | 0.2 | 0.2 | 0.2 |
| | 100 | 46.901 | 100 | 47.501 | 100 | 45.901 | 100 | 47.501 | 100 | 48.056 |
| Properties | | | | | | | | | | |
| Mg:Na in LAS (Mole Ratio) | 1:1 | | 1:1 | | 1:1 | | 1:1 | | 1:1 | |
| LAS:APG (Solids Content Weight Ratio) | 3.5:1 | | 3.5:1 | | 3.5:1 | | 3.5:1 | | 3.5:1 | |
| AES:APG (Solids Content Weight Ratio) | 0.9:1 | | 0.9:1 | | 0.9:1 | | 0.9:1 | | 0.9:1 | |
| Prim:Second (Solids Content Weight Ratio) | 4.4:1 | | 4.4:1 | | 4.4:1 | | 4.4:1 | | 4.4:1 | |

TABLE 14

| | Formula # 138-12-10 | | Formula # 138-12-1 | | Formula # 138-12-4 | | Formula # 138-12-5 | |
|---|---|---|---|---|---|---|---|---|
| Ingredients | Conc. % | Solids % | Conc. % | Solids % | Conc. % | Solids % | Conc. % | Solids % |
| Water | 36.198 | 0.000 | 39.148 | 0.000 | 38.188 | 0.000 | 43.1888 | 0.000 |
| Dodecyl Benzene Sulfonic Acid (Biosoft S-100) | 24 | 24 | 24 | 24 | 24 | 24 | 24 | 24 |
| Magnesium Oxide | 1.6 | 1.6 | 1.7 | 1.7 | 1.66 | 1.66 | 1.66 | 1.66 |
| Triethanol Amide-TEA | 0.5 | 0.5 | 0 | 0 | 0 | 0 | 0 | 0 |
| Lauramide/ Myristamide MEA (Ninol NMP) | 4 | 4 | 4 | 4 | 4 | 4 | 3 | 3 |
| Coco DEA-Standamid SD-K | 0 | 0 | 0 | 0 | 0 | 0 | 0 | 0 |
| Surfonic NP 9.5 | 1.5 | 1.5 | 0 | 0 | 0 | 0 | 0 | 0 |
| α-Sulfomethyl Ester (α Step MC 48) | 16 | 5.92 | 16 | 5.92 | 16 | 5.92 | 16 | 5.92 |
| Alcohol Ether Sulfate - 2EO (Texapon NC 70) | 6 | 4.2 | 6 | 4.2 | 0 | 0 | 4 | 2.8 |
| Alcohol Ether Sulfate - 4EO (Steol CS 460) | 0 | 0 | 0 | 0 | 7 | 4.2 | 0 | 0 |
| Sodium Lauroamphoacetate (Miranol HMA) | 0 | 0 | 4 | 1.24 | 4 | 1.24 | 3 | 0.93 |
| Magnesium Sulfate | 5 | 1.35 | 0 | 0 | 0 | 0 | 0 | 0 |
| Ethanol (SDA-3A) | 5 | 5 | 5 | 5 | 5 | 5 | 5 | 5 |
| Perfume (SZ Lemon 1057) | 0.2 | 0.2 | 0.15 | 0.15 | 0.15 | 0.15 | 0.15 | 0.15 |
| Dye, Blue, (PYLAKOR LX) | 0.002 | 0.002 | 0.002 | 0.002 | 0.002 | 0.002 | 0.002 | 0.002 |
| | 100 | 48.272 | 100 | 46.212 | 100 | 46.1721 | 100 | 43.462 |
| Properties | | | | | | | | |
| Mg:Na in LAS (Mole Ratio) | Mg(1) | | Mg(1) | | Mg(1) | | Mg(1) | |
| LAS:SME (Solids Content Weight Ratio) | 4:1 | | 4:1 | | 4:1 | | 4:1 | |
| Primary:Secondary (Solids Content Weight Ratio) | 4.8:1 | | 4.8:1 | | 4.8:1 | | 4.5:1 | |
| Foam Height - Initial, mL | 430 | | 350 | | 400 | | 410 | |
| Foam Height with Soil, mL | 370 | | 315 | | 340 | | 335 | |
| Foam Height - Regeneration, mL | 300 | | 325 | | 285 | | 285 | |
| Grease Emulsification - Initial, mL | 1 | | 1 | | 1 | | 1 | |
| Pellet Sudge End Point | 17 | | 16 | | 17 | | 18 | |

| | Formula # 138-12-6 | | Formula # 138-12-7 | | Formula # 138-12-8 | | Formula # 138-12-9 | |
|---|---|---|---|---|---|---|---|---|
| Ingredients | Conc. % | Solids % | Conc. % | Solids % | Conc. % | Solids % | Conc. % | Solids % |
| Water | 42.498 | 0.000 | 45.568 | 0.000 | 47.568 | 0.000 | 41.148 | 0.000 |
| Dodecyl Benzene Sulfonic Acid (Biosoft S-100) | 24 | 24 | 18 | 18 | 18 | 18 | 24 | 24 |
| Magnesium Oxide | 1.65 | 1.65 | 1.28 | 1.28 | 1.28 | 1.28 | 1.7 | 1.7 |
| Triethanol Amide-TEA | 0 | 0 | 0 | 0 | 0 | 0 | 0 | 0 |
| Lauramide/ Myristamide MEA (Ninol NMP) | 0 | 0 | 4 | 4 | 4 | 4 | 4 | 4 |
| Coco DEA-Standamid SD-K | 3 | 3 | 0 | 0 | 0 | 0 | 0 | 0 |
| Surfonic NP 9.5 | 0 | 0 | 0 | 0 | 0 | 0 | 0 | 0 |
| α-Sulfomethyl Ester (α Step MC 48) | 16 | 5.92 | 16 | 5.92 | 16 | 5.92 | 16 | 5.92 |
| Alcohol Ether Sulfate - 2EO (Texapon NC 70) | 0 | 0 | 6 | 4.2 | 4 | 2.8 | 4 | 2.8 |
| Alcohol Ether Sulfate - 4EO (Steol CS 460) | 4.7 | 2.82 | 0 | 0 | 0 | 0 | 0 | 0 |
| Sodium Lauroamphoacetate (Miranol HMA) | 3 | 0.93 | 4 | 1.24 | 4 | 1.24 | 4 | 1.24 |
| Magnesium Sulfate | 0 | 0 | 0 | 0 | 0 | 0 | 0 | 0 |
| Ethanol (SDA-3A) | 5 | 5 | 5 | 5 | 5 | 5 | 5 | 5 |
| Perfume (SZ Lemon 1057) | 0.15 | 0.15 | 0.15 | 0.15 | 0.15 | 0.15 | 0.15 | 0.15 |
| Dye, Blue, (PYLAKOR LX) | 0.002 | 0.002 | 0.002 | 0.002 | 0.002 | 0.002 | 0.002 | 0.002 |
| | 100 | 43.472 | 100 | 39.792 | 100 | 38.392 | 100 | 44.812 |
| Properties | | | | | | | | |
| Mg:Na in LAS (Mole Ratio) | Mg(1) | | Mg(1) | | Mg(1) | | Mg(1) | |
| LAS:SME (Solids Content Weight Ratio) | 4:1 | | 3:1 | | 3:1 | | 4:1 | |
| Primary:Secondary (Solids | 4.5:1 | | 3.8:1 | | 3.5:1 | | 4.5:1 | |

TABLE 14-continued

| | | | | |
|---|---|---|---|---|
| Content Weight Ratio) | | | | |
| Foam Height - Initial, mL | 415 | 415 | 415 | 415 |
| Foam Height with Soil, mL | 265 | 265 | 265 | 265 |
| Foam Height - Regeneration, mL | 255 | 255 | 255 | 255 |
| Grease Emulsification - Initial, mL | 1 | 1 | 1 | 1 |
| Pellet Sudge End Point | 16 | 16 | 16 | 16 |

TABLE 15

| | Formula # 102-100-2 | | Formula # 138-78-4 | | Formula # 138-97-1 | |
|---|---|---|---|---|---|---|
| Ingredients | Conc. % | Solids % | Conc. % | Solids % | Conc. % | Solids % |
| Water | 30.873 | 0 | 35.573 | 0 | 31.973 | 0 |
| Dodecyl Benzene Sulfonic Acid (Biosoft S-100) | 21 | 21 | 21 | 21 | 21 | 21 |
| Magnesium Oxide | 0.8 | 0.8 | 0.8 | 0.8 | 0.8 | 0.8 |
| Sodium Hydroxide (50%) | 2 | 1 | 2 | 1 | 2 | 1 |
| Triethanol Amide-TEA | 1 | 1 | 1 | 0 | 1 | 0 |
| Lauramide/Myristamide MEA (Ninol NMP) | 4 | 4 | 2 | 2 | 2 | 2 |
| Coco DEA-Standamid SD-K | 0 | 0 | 0 | 0 | 0 | 0 |
| Cocoamidopropyl betaine (Velvetex BA-35) | 0 | 0 | 0 | 0 | 0 | 0 |
| Alkyl Poly Glucoside (Glucopon 625 FE) | 15 | 6 | 15 | 6 | 15 | 6 |
| Alcohol Ether Sulfate - 2EO (Texapon NC 70) | 8 | 5.6 | 11 | 7.7 | 11 | 7.7 |
| Sodium Lauroamphoacetate (Miranol HMA) | 4 | 1.24 | 2 | 0.62 | 4 | 1.24 |
| Sodium Xylene Sulfonate (40%) | 4 | 1.6 | 3.5 | 1.4 | 4 | 1.6 |
| Ethanol (SDA-3A) | 6 | 6 | 4 | 4 | 4 | 4 |
| Propylene glycol | 3 | 3 | 2 | 2 | 3 | 3 |
| Glutaraldehyde (Ucarcide 250) | 0.02 | 0.01 | 0.02 | 0.01 | 0.02 | 0.01 |
| Perfume (SZ Lemon 1057) | 0.3 | 0.3 | 0.1 | 0.1 | 0.2 | 0.2 |
| Dye, FD & C Blue #1 | 0.002 | 0.002 | 0.002 | 0.002 | 0.002 | 0.002 |
| Dye, Acid Yellow #23 | 0.005 | 0.005 | 0.005 | 0.005 | 0.005 | 0.005 |
| Properties | | | | | | |
| Mg:Na in LAS (Mole Ratio) | 1:1 | | 1:1 | | 1:1 | |
| LAS:APG (Solids Content Weight Ratio) | 3.5:1 | | 3.5:1 | | 3.5:1 | |
| Primary:Secondary (Solids Content Weight Ratio) | 4.4:1 | | 4.8:1 | | 4.8:1 | |
| Foam Height - Initial, mL | 430 | | 400 | | 415 | |
| Foam Height with Soil, mL | 370 | | | | | |
| Foam Height - Regeneration, mL | 300 | | | | | |

TABLE 16

| | Non-Las Formulations | | | | | | | |
|---|---|---|---|---|---|---|---|---|
| | Non-LAS #1 | | Non-LAS #2 | | Non-LAS #3 | | Non-LAS #4 | |
| Ingredients | Conc. % | Solids % | Conc. % | Solids % | Conc. % | Solids % | Conc. % | Solids % |
| Water | qs | 0 | qs | 0 | qs | 0 | qs | 0 |
| Alpha-Olefin Sulfonate (Bioterge AS-40) | 0 | 0 | 0 | 0 | 25 | 10 | 0 | 0 |
| Sodium Lauryl Sulfate (29%) | 0 | 0 | 0 | 0 | 0 | 0 | 65 | 18.85 |
| Alcohol Ether Sulfate - 1EO (25%) | 0 | 0 | 0 | 0 | 0 | 0 | 0 | 0 |
| Alcohol Ether Sulfate - 2EO (Texapon NC 70) | 28.5 | 19.95 | 28.5 | 19.95 | 0 | 0 | 0 | 0 |
| Lauramide/Myristamide MEA (Ninol NMP) | 2 | 2 | 0 | 0 | 2 | 2 | 0 | 0 |
| Coco DEA-Standamid SD-K | 0 | 0 | 2 | 2 | 0 | 0 | 2 | 2 |
| Alkyl Poly Glucoside (Glucopon 625 FE) | 10 | 4 | 10 | 4 | 25 | 10 | 12 | 4.8 |
| Sodium Lauroamphoacetate (Miranol HMA) | 4 | 1.24 | 0 | 0 | 0 | 0 | 0 | 0 |
| Sodium Xylene Sulfonate (40%) | 10 | 4 | 10 | 4 | 10 | 4 | 10 | 4 |

TABLE 16-continued

| | | | | | | | | |
|---|---|---|---|---|---|---|---|---|
| Ethanol (SDA-3A) | 1 | 1 | 1 | 1 | 1 | 1 | 0 | 0 |
| Amine Oxide (Slantamox 30%) | 0 | 0 | 0 | 0 | 0 | 0 | 0 | 0 |
| Cocoamidopropyl betaine (Velvetex BA-35) | 0 | 0 | 6 | 2.1 | 0 | 0 | 2 | 0.7 |
| Propylene glycol | 1 | 1 | 1 | 1 | 1 | 1 | 1 | 1 |
| Glutaraldehyde (Ucarcide 250) | 0.02 | 0.01 | 0.02 | 0.01 | 0.02 | 0.01 | 0.02 | 0.01 |
| Perfume (SZ Lemon 1057) | 0.1 | 0.1 | 0.1 | 0.1 | 0.3 | 0.3 | 0.1 | 0.1 |
| Dye, FD & C Blue #1 | 0.002 | 0.002 | 0.002 | 0.002 | 0.002 | 0.002 | 0.002 | 0.002 |
| Dye, Acid Yellow #23 | 0.005 | 0.005 | 0.005 | 0.005 | 0.005 | 0.005 | 0.005 | 0.005 |
| Properties | | | | | | | | |
| Non-Las:APG (Solids Content Weight Ratio) | 5:1 | | 5:1 | | 1:1 | | 3.9:1 | |
| Primary:Secondary (Solids Content Weight Ratio) | 5:1 | | 5:1 | | 1:1 | | 3.9:1 | |
| Foam Height - Initial, mL | 386 | | 386 | | | | | |

| | Non-Las Formulations | | | | | |
|---|---|---|---|---|---|---|
| | Non-LAS #5 | | Non-LAS #6 | | Non-LAS #7 | |
| Ingredients | Conc. % | Solids % | Conc. % | Solids % | Conc. % | Solids % |
| Water | qs | 0 | qs | 0 | qs | 0 |
| Alpha-Olefin Sulfonate (Bioterge AS-40) | 0 | 0 | 0 | 0 | 0 | 0 |
| Sodium Lauryl Sulfate (29%) | 0 | 0 | 0 | 0 | 0 | 0 |
| Alcohol Ether Sulfate - 1EO (25%) | 76 | 19 | 0 | 0 | 0 | 0 |
| Alcohol Ether Sulfate - 2EO (Texapon NC 70) | 0 | 0 | 27 | 18.9 | 40 | 28 |
| Lauramide/Myristamide MEA (Ninol NMP) | 0 | 0 | 0 | 0 | 0 | 0 |
| Coco DEA-Standamid SD-K | 2 | 2 | 2 | 2 | 3 | 3 |
| Alkyl Poly Glucoside (Glucopon 625 FE) | 12 | 4.8 | 12 | 4.8 | 15 | 6 |
| Sodium Lauroamphoacetate (Miranol HMA) | 0 | 0 | 0 | 0 | 0 | 0 |
| Sodium Xylene Sulfonate (40%) | 4 | 1.6 | 10 | 4 | 6 | 2.4 |
| Ethanol (SDA-3A) | 0 | 0 | 0 | 0 | 6 | 6 |
| Amine Oxide (Slantamox 30%) | 0 | 0 | 0 | 0 | 10 | 3 |
| Cocoamidopropyl betaine (Velvetex BA-35) | 2 | 0.7 | 2 | 0.7 | 3 | 1.05 |
| Propylene glycol | 1 | 1 | 1 | 1 | 1 | 1 |
| Glutaraldehyde (Ucarcide 250) | 0.02 | 0.01 | 0.02 | 0.01 | 0.02 | 0.01 |
| Perfume (SZ Lemon 1057) | 0.2 | 0.2 | 0.1 | 0.1 | 0.1 | 0.1 |
| Dye, FD & C Blue #1 | 0.002 | 0.002 | 0.002 | 0.002 | 0.002 | 0.002 |
| Dye, Acid Yellow #23 | 0.005 | 0.005 | 0.005 | 0.005 | 0.005 | 0.005 |
| Properties | | | | | | |
| Non-Las:APG (Solids Content Weight Ratio) | 4:1 | | 3.9:1 | | 4.7:1 | |
| Primary:Secondary (Solids Content Weight Ratio) | 4:1 | | 3.9:1 | | 4.7:1 | |
| Foam Height - Initial, mL | | | | | | |

Table 16 sets forth various compositions according to the present invention that do not contain a linear alkyl benzene sulfonic acid, a linear alkyl benzene sulfonate or an alkali metal, alkaline earth metal, amine, and ammonium or salt thereof as the primary surfactant.

Table 17 sets forth a comparison between a detergent composition according to the present invention, and two commercially available detergent products. The commercially available detergent products, outside the scope of the present invention, did not contain a linear alkyl benzene sulfonic acid or salt thereof or an alkyl polyglycoside. Table 17 shows that the Formula #138-78-4 possessed significantly improved overall foaming properties when compared to the two commercially available products.

TABLE 17

PERFORMANCE COMPARISON

| Ingredients | Formula # 138-78-4 Conc. % | Formula # 138-78-4 Solids % | Premium Commercial Product A Conc. % | Premium Commercial Product A Solids % | Premium Commercial Product B Conc. % | Premium Commercial Product B Solids % |
|---|---|---|---|---|---|---|
| Water | 35.573 | 0 | 17 | 0 | 47 | 0 |
| Dodecyl Benzene Sulfonic Acid (Biosoft S-100) | 21 | 21 | 0 | 0 | 0 | 0 |
| Magnesium Oxide | 0.8 | 0.8 | 0 | 0 | 0 | 0 |
| Sodium Hydroxide (50%) | 2 | 1 | 0 | 0 | 0 | 0 |
| Magnesium Chloride | 0 | 0 | 2 | 2 | 2 | 2 |
| Calcium Chloride | 0 | 0 | 0 | 0 | 1 | 1 |
| Triethanol Amide-TEA | 1 | 0 | 0 | 0 | 0 | 0 |
| Lauramide/Myristamide MEA (Ninol NMP) | 2 | 2 | 0 | 0 | 0 | 0 |
| Coco APAO-Standamox CA | 0 | 0 | 20 | 6 | 3 | 0.9 |
| Alkyl Glucosamide (P & G Prop) | 0 | 0 | 6 | 6 | 0 | 0 |
| Alkyl Poly Glucoside (Glucopon 625 FE) | 15 | 6 | 0 | 0 | 0 | 0 |
| Alcohol Ether Sulfate - 2EO (Texapon NC 70) | 11 | 7.7 | 40 | 28 | 36 | 25.2 |
| Sodium Lauroamphoacetate (Miranol HMA) | 2 | 0.62 | 0 | 0 | 0 | 0 |
| Sodium Xylene Sulfonate (40%) | 3.5 | 1.4 | 5 | 2 | 4 | 1.6 |
| Ethanol (SDA-3A) | 4 | 4 | 5 | 5 | 3 | 3 |
| Ethoxy Alcohol (Neodol 1-9) | 0 | 0 | 5 | 5 | 4 | 4 |
| Propylene glycol | 2 | 2 | 0 | 0 | 0 | 0 |
| Glutaraldehyde (Ucarcide 250) | 0.02 | 0.01 | 0 | 0 | 0 | 0 |
| Properties | | | | | | |
| Mg:Na in LAS (Mole Ratio) | 1:1 | | n/a | | n/a | |
| LAS:APG (Solids Content Weight Ratio) | 3.5:1 | | n/a | | n/a | |
| Primary:Secondary (Solids Content Weight Ratio) | 4.8:1 | | n/a | | n/a | |
| Concentration | 0.15 fl. oz./gal | 0.10 fl. oz./gal | 0.15 fl. oz./gal | | 0.15 fl. oz./gal | |
| Foam Height - Initial, mL | 563 | 455 | 510 | | 515 | |
| Foam Height with 15 Drops of Oil, mL | 423 | 330 | 340 | | 350 | |
| Foam Retention after 6 Minutes, mL | 260 | n/a | 200 | | 220 | |
| Foam Retention after 8 Minutes, mL | 225 | n/a | 165 | | 170 | |
| Foam Retention after 10 Minutes, mL | n/a | 167 | n/a | | n/a | |
| Foam Height - Regeneration, mL | 160 | 110 | 125 | | 125 | |
| Grease Emulsification - Foam | Plus (+) | Standard (=) | Plus (+) | | Plus (+) | |

The foregoing tables demonstrate the improved foaming and emulsifying properties directly attributed to the compositions of the present invention. Within the scope of the present invention, the results set forth above demonstrate that a detergent composition comprising an alkyl polyglycoside as the secondary surfactant had better foam generation and foam stability than a detergent composition containing an α-sulfomethyl esther secondary surfactant. With respect to a detergent composition comprising an alkyl polyglycoside surfactant, compositions which contain a mixed salt of dodecylbenzene sulfonate perform better than compositions containing a single salt. Additionally, the results demonstrate that performance was better in these compositions when a higher primary-to-secondary surfactant ratio was used.

With respect to detergent compositions comprising the α-sulfomethyl esther secondary surfactant, the results demonstrate that magnesium salts of dodecylbenzene sulfonates perform better than compositions containing mixed salts of dodecylbenzene sulfonate. Additionally, the performance of these compositions containing the SME surfactant was better when a lower ratio of primary-to secondary surfactant was used.

What is claimed is:

1. A detergent composition consisting essentially of a primary surfactant system, a secondary surfactant system, water, and one or more optional additives selected from the group consisting of an alkanolamide; an amphoteric surfactant; an antibacterial agent; an antimicrobial agent; an aryl sulfonate; ethanol; an ethoxylated alcohol; magnesium oxide; magnesium chloride; sodium hydroxide; a preservative; a perfume; a thickener; a dye; a $C_8$–$C_{18}$ sulfosuccinate, a $C_8$–$C_{18}$ sulfosuccinamate, a $C_8$–$C_{18}$ surcosinate, and alkali metal, alkaline earth metal, amine and ammonium salts thereof; and a combination thereof;

wherein said primary surfactant system consists of at least one primary surfactant selected from the group consisting of a linear alkyl benzene sulfonic acid, a linear alkyl benzene sulfonate, an α-olefin sulfonate, an alcohol ether sulfate, an alkyl sulfate, and alkali metal, alkaline earth metal, amine and ammonium salts thereof, wherein said secondary surfactant system consists of at least one secondary surfactant selected from the group consisting of an alkyl polyglycosides, and wherein the weight ratio of said at least one primary surfactant to said at least one secondary surfactant, based on the solids content of said detergent composition, is at least 3:1.

2. A composition according to claim 1, wherein said weight ratio of said at least one primary surfactant to said at least one secondary surfactant ranges from 3:1 to 6:1.

3. A composition according to claim 1, wherein said primary surfactant system consists of at least one primary surfactant selected from the group consisting of a linear $C_{10}$–$C_{16}$ alkyl benzene sulfonic acid, a linear $C_{10}$–$C_{16}$ alkyl benzene sulfonate, and an alkali metal, alkaline earth metal, amine and ammonium salt thereof.

4. A composition according to claim 3, wherein said at least one primary surfactant is selected from the group consisting of dodecylbenzene sulfonic acid, dodecylbenzene sulfonate, decylbenzene sulfonate, undecylbenzene sulfonate, tridecylbenzene sulfonate, nonylbenzene sulfonate and alkali metal, alkaline earth metal, amine and ammonium salts thereof.

5. A composition according to claim 4, wherein said alkali metal, alkaline earth metal, amine and ammonium salts comprise at least one cation selected from the group consisting of sodium, potassium, ammonium, mono-alkanolammonium, di-alkanolammonium, tri-alkanolammonium, and magnesium.

6. A composition according to claim 4, wherein said at least one primary surfactant is dodecylbenzene sulfonic acid, magnesium dodecylbenzene sulfonate, sodium dodecylbenzene sulfonate, triethanolammonium dodecylbenzene sulfonate, magnesium/sodium dodecylbenzene sulfonate, or magnesium/sodium/triethanolammonium dodecylbenzene sulfonate.

7. A composition according to claim 6, wherein the mole ratio of Mg:Na in said magnesium/sodium dodecylbenzene sulfonate ranges from 1:3 to 3:1.

8. A composition according to claim 7, wherein the mole ratio of Mg:Na in said magnesium/sodium dodecylbenzene sulfonate is 1:1.

9. A composition according to claim 6, wherein the mole ratio of Mg:Na in said magnesium/sodium/triethanolammonium dodecylbenzene sulfonate ranges from 1:3 to 3:1, and the mole ratio of $(HOCH_2CH_2)_3NH$:Na in said magnesium/sodium/triethanolammonium dodecylbenzene sulfonate ranges from 0.1:1 to 1:1.

10. A composition according to claim 6, wherein the mole ratio of Mg:Na:$(HOCH_2CH_2)_3NH$ in said magnesium/sodium/triethanolammonium dodecylbenzene sulfonate ranges from 1:1:0.5 to 1:1:1.

11. A composition according to claim 1, wherein said primary surfactant system consists of at least one primary surfactant selected from the group consisting of an α-olefin sulfonate, an alcohol ether sulfate, an alkyl sulfate, and alkali metal, alkaline earth metal, amine and ammonium salts thereof.

12. A composition according to claim 11, wherein said alkali metal, alkaline earth metal, amine and ammonium salts comprise at least one cation selected from the group consisting of sodium, potassium, ammonium, mono-alkanolammonium, di-alkanolammonium, tri-alkanolammonium, and magnesium.

13. A composition according to claim 11, wherein said α-olefin sulfonate or alkali metal, alkaline earth metal, amine and ammonium salt thereof is a $C_{14}$–$C_{16}$ α-olefin sulfonate.

14. A composition according to claim 13, wherein said $C_{14}$–$C_{16}$ α-olefin sulfonate or alkali metal, alkaline earth metal, amine and ammonium salt thereof is sodium $C_{14}$–$C_{16}$ α-olefin sulfonate.

15. A composition according to claim 11, wherein said alcohol ether sulfate or alkali metal, alkaline earth metal, amine and ammonium salt thereof has 1 to 4 moles of ethoxylation.

16. A composition according to claim 15, wherein said alcohol ether sulfate or alkali metal, alkaline earth metal, amine and ammonium salt thereof is selected from the group consisting of ammonium laureth-1-sulfate, ammonium laureth-2-sulfate, ammonium laureth-3-sulfate, ammonium myreth-3-sulfate, sodium laureth-1-sulfate, sodium laureth-2-sulfate, sodium laureth-3-sulfate and sodium myreth-3-sulfate.

17. A composition according to claim 11, wherein said alkyl sulfate or alkali metal, alkaline earth metal, amine and ammonium salt thereof is selected from the group consisting of sodium lauryl sulfate, magnesium lauryl sulfate, ammonium lauryl sulfate and triethanolammonium lauryl sulfate.

18. A composition according to claim 1, wherein said primary surfactant system consists of:

a) at least one linear $C_{10}$–$C_{16}$ alkyl benzene sulfonic acid, linear $C_{10}$–$C_{16}$ alkyl benzene sulfonate or alkali metal, alkaline earth metal, amine and ammonium salt thereof; and b) at least one additional primary surfactant selected from the group consisting of an α-olefin sulfonate, an alcohol ether sulfate, an alkyl sulfate, and alkali metal, alkaline earth metal, amine and ammonium salts thereof.

19. A composition according to claim 18, wherein a) said at least one linear $C_{10}$–$C_{16}$ alkyl benzene sulfonic acid, linear $C_{10}$–$C_{16}$ alkyl benzene sulfonate or alkali metal, alkaline earth metal, amine and ammonium salts thereof is selected from the group consisting of dodecylbenzene sulfonic acid, magnesium dodecylbenzene sulfonate, sodium dodecylbenzene sulfonate, magnesium/sodium dodecylbenzene sulfonate and magnesium/sodium/triethanolamine dodecylbenzene sulfonate; and b) said at least one additional primary surfactant is selected from the group consisting of an alcohol ether sulfate and an alkali metal, alkaline earth metal, amine and ammonium salt thereof having 1 to 4 moles of ethoxylation.

20. A composition according to claim 19, wherein said at least one additional primary surfactant is present in an amount ranging from 5 to 30% by weight, based on the weight of said composition.

21. A composition according to claim 1, wherein said secondary surfactant system consists of at least one secondary surfactant selected from the group consisting of a $C_8$ to $C_{16}$ alkyl polyglycoside.

22. A composition according to claim 21, wherein said $C_8$–$C_{16}$ alkyl polyglycoside has the following chemical structure:

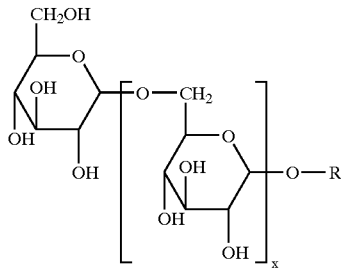

wherein R is an alkyl group having 8 to 16 carbon atoms, and x ranges from 0 to 3.

23. A composition according to claim 22, wherein said $C_8$ to $C_{16}$ alkyl polyglycoside is selected from the group consisting of a $C_8$ to $C_{10}$ alkyl polyglycoside with a degree of polymerization of 1.5, a $C_8$ to $C_{10}$ alkyl polyglycoside with a degree of polymerization of 1.6, a $C_8$ to $C_{10}$ alkyl polyglycoside with a degree of polymerization of 1.7, a $C_8$–$C_{16}$ alkyl polyglycoside with a degree of polymerization of 1.45, a $C_{12}$–$C_{16}$ alkyl polyglycoside with a degree of polymerization of 1.4, a $C_8$–$C_{14}$ alkyl polyglycoside with a degree of polymerization of 1.4, a $C_8$–$C_{14}$ alkyl polyglycoside with a degree of polymerization of 1.5, a $C_{12}$–$C_{14}$ alkyl polyglycoside with a degree of polymerization of 1.4, and a $C_{12}$–$C_{16}$ alkyl polyglycoside with a degree of polymerization of 1.6.

24. A composition according to claim 1, wherein said secondary surfactant system is present in an amount ranging from 2 to 30% by weight, based on the weight of said composition.

25. A composition according to claim 1, further comprising at least one alkanolamide.

26. A composition according to claim 25, wherein said at least one alkanolamide is a lower alkanolamide of a higher alkanoic acid.

27. A composition according to claim 26, wherein said at least one alkanolamide is a mono-alkanolamide selected from the group consisting of lauryl/myristic monoethanolamide and coco monoethanolamide.

28. A composition according to claim 25, wherein said at least one alkanolamide is present in an amount ranging from 0.5 to 10% by weight, based on the weight of said composition.

29. A composition according to claim 1, further comprising at least one amphoteric surfactant.

30. A composition according to claim 29, wherein said at least one amphoteric surfactant is selected from the group consisting of cocoamidopropyl betaine, sodium cocoamphoacetate, sodium lauroamphoacetate and sodium cocoamphodiacetate.

31. A composition according to claim 29, wherein said at least one amphoteric surfactant is present in an amount ranging from 0.5 to 10% by weight, based on the weight of said composition.

32. A composition according to claim 1, further comprising at least one antibacterial agent.

33. A composition according to claim 32, wherein said at least one antibacterial agent is selected from the group consisting of 2,4,4'-trichloro-2'-hydroxydiphenyl ether, 4-chloro-3,5-dimethyl phenol, EDTA, EDTA-$Na_4$, and glutaraldehyde.

34. A composition according to claim 33, wherein said at least one antibacterial agent is present in an amount ranging from 0.1 to 10% by weight, based on the weight of said composition.

35. A detergent composition consisting essentially of a primary surfactant system, a secondary surfactant system, water, and one or more optional additives selected from the group consisting of an alkanolamide; an amphoteric surfactant; an antibacterial agent; an antimicrobial agent; an aryl sulfonate; ethanol; an ethoxylated alcohol; magnesium oxide; magnesium chloride; sodium hydroxide; a preservative; a perfume; a thickener; a dye; a $C_8$–$C_{18}$ sulfosuccinate, a $C_8$–$C_{18}$ sulfosuccinamate, a $C_8$–$C_{18}$ surcosinate, and alkali metal, alkaline earth metal, amine and ammonium salts thereof; and a combination thereof;

wherein said primary surfactant system consists of a) at least one linear $C_{10}$–$C_{16}$ alkyl benzene sulfonic acid or alkali metal, alkaline earth metal, amine and ammonium salt thereof selected from the group consisting of dodecylbenzene sulfonic acid, magnesium dodecylbenzene sulfonate, sodium dodecylbenzene sulfonate, triethanolammonium dodecylbenzene sulfonate, magnesium/sodium dodecylbenzene sulfonate, and magnesium/sodium/triethanol ammonium dodecylbenzene sulfonate, and b) at least one alcohol ether sulfate having 1 to 4 moles of ethoxylation;

wherein said secondary surfactant system consists of at least one $C_8$ to $C_{16}$ alkyl polyglycoside with a degree of polymerization ranging from 1 to 3, and wherein the weight ratio of said at least one linear $C_{10}$–$C_{16}$ alkyl benzene sulfonic acid or alkali metal, alkaline earth metal, amine and ammonium salt thereof to said at least one $C_8$ to $C_{16}$ alkyl polyglycoside, based on the solids content of said detergent composition, ranges from 3:1 to 5:1.

36. A composition according to claim 35, wherein said weight ratio of said at least one linear $C_{10}$–$C_{16}$ alkyl benzene sulfonic acid or salt thereof to said at least one $C_8$ to $C_{16}$ alkyl polyglycoside ranges from 3.5:1 to 5:1.

37. A detergent composition consisting essentially of a primary surfactant system, a secondary surfactant system, water, and one or more optional additives selected from the group consisting of an alkanolamide; an amphoteric surfactant; an antibacterial agent; an antimicrobial agent; an aryl sulfonate; ethanol; an ethoxylated alcohol; magnesium oxide; magnesium chloride; sodium hydroxide; a preservative; a perfume; a thickener; a dye; a $C_8$–$C_{18}$ sulfosuccinate, a $C_8$–$C_{18}$ sulfosuccinamate, a $C_8$–$C_{18}$ surcosinate, and alkali metal, alkaline earth metal, amine and ammonium salts thereof; and a combination thereof;

wherein said primary surfactant system consists of at least one primary surfactant selected from the group consisting of a linear alkyl benzene sulfonic acid, a linear alkyl benzene sulfonate, an α-olefin sulfonate, an alcohol ether sulfate, an alkyl sulfate, and alkali metal, alkaline earth metal, amine and ammonium salts thereof, wherein said secondary surfactant system consists of at least one alkyl polyglycoside, at least one α-sulfomethyl ester having the following chemical structure:

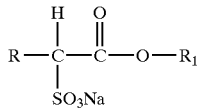

wherein R is an alkyl group having 10 to 16 carbon atoms, and $R_1$ is a sodium atom, and mixtures thereof, and wherein the weight ratio of said at least one primary surfactant system to said secondary surfactant system, based on the solids content of said detergent composition, is at least 2.7:1.

38. A composition according to claim 37, wherein said primary surfactant system consists of a) at least one linear $C_{10}$–$C_{16}$ alkyl benzene sulfonic acid or alkali metal, alkaline earth metal, amine and ammonium salt thereof selected from the group consisting of dodecylbenzene sulfonic acid, magnesium dodecylbenzene sulfonate, sodium dodecylbenzene sulfonate, triethanolammonium dodecylbenzene sulfonate, magnesium/sodium dodecylbenzene sulfonate, and magnesium/sodium/triethanolammonium dodecylbenzene sulfonate, and b) at least one alcohol ether sulfate having 1 to 4 moles of ethoxylation.

39. A composition according to claim 37, wherein said weight ratio of said at least one primary surfactant system to said secondary surfactant system ranges from 3:1 to 6:1.

40. A method for cleaning soiled dishware, pots and/or pans, said method comprising contacting said soiled dishware, pots and/or pans with a detergent composition consisting essentially of a primary surfactant system, a secondary surfactant system, water, and one or more optional additives selected from the group consisting of an alkanolamide; an amphoteric surfactant; an antibacterial agent; an antimicrobial agent; an aryl sulfonate; ethanol; an ethoxylated alcohol; magnesium oxide; magnesium chloride; sodium hydroxide; a preservative; a perfume; a thickener; a dye; a $C_8$–$C_{18}$ sulfosuccinate, a $C_8$–$C_{18}$ sulfosuccinamate, a $C_8$–$C_{18}$ surcosinate, and alkali metal, alkaline earth metal, amine and ammonium salts thereof; and a combination thereof; and removing the soil from said dishware, wherein said primary surfactant system consists of at least one primary surfactant selected from the group consisting of a linear alkyl benzene sulfonic acid, a linear alkyl benzene sulfonate, an α-olefin sulfonate, an alcohol ether sulfate, an alkyl sulfate, and alkali metal, alkaline earth metal, amine and ammonium salts thereof, wherein said secondary surfactant system consists of at least one secondary surfactant selected from the group consisting of an alkyl polyglycoside and an α-sulfomethyl ester having the following chemical structure:

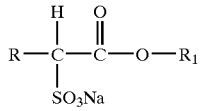

wherein R is an alkyl group having 10 to 16 carbon atoms, and $R_1$ is a sodium atom, and wherein the weight ratio of said at least one primary surfactant to said at least one secondary surfactant, based on the solids content of said detergent composition, is at least 3:1.

41. A composition according to claim 1, further comprising at least one additive selected from the group consisting of a $C_8$–$C_{18}$ sulfosuccinate, a $C_8$–$C_{18}$ sulfosuccinamate, a $C_8$–$C_{18}$ surcosinate, and alkali metal, alkaline earth metal, amine and ammonium salts thereof.

42. A composition according to claim 25, further comprising (i) ethanol, (ii) an ethoxylated alcohol, (iii) an amphoteric surfactant, (iv) sodium xylene sulfonate or sodium cumene sulfonate, and (v) at least one additive selected from the group consisting of magnesium oxide, magnesium chloride and sodium hydroxide.

43. A composition according to claim 25, further comprising (i) ethanol, (ii) an ethoxylated alcohol, and (iii) an amphoteric surfactant.

44. A composition according to claim 1, further comprising (i) ethanol, (ii) sodium xylene sulfonate or sodium cumene sulfonate, and (iii) at least one additive selected from the group consisting of magnesium oxide, magnesium chloride and sodium hydroxide.

45. A composition according to claim 35, further comprising at least one additive selected from the group consisting of a $C_8$–$C_{18}$ sulfosuccinate, a $C_8$–$C_{18}$ sulfosuccinamate, a $C_8$–$C_{18}$ surcosinate, and alkali metal, alkaline earth metal, amine and ammonium salts thereof.

46. A composition according to claim 35, further comprising (i) ethanol, (ii) an ethoxylated alcohol, (iii) an amphoteric surfactant, (iv) sodium xylene sulfonate or sodium cumene sulfonate, (v) at least one additive selected from the group consisting of magnesium oxide, magnesium chloride and sodium hydroxide.

47. A composition according to claim 35, further comprising (i) ethanol, (ii) an ethoxylated alcohol, and (iii) an amphoteric surfactant.

48. A composition according to claim 35, further comprising (i) ethanol, (ii) sodium xylene sulfonate or sodium cumene sulfonate, and (iii) at least one additive selected from the group consisting of magnesium oxide, magnesium chloride and sodium hydroxide.

49. A composition according to claim 37, further comprising at least one additive selected from the group consisting of a $C_8$–$C_{18}$ sulfosuccinate, a $C_8$–$C_{18}$ sulfosuccinamate, a $C_8$–$C_{18}$ surcosinate, and alkali metal, alkaline earth metal, amine and ammonium salts thereof.

50. A composition according to claim 37, further comprising (i) ethanol, (ii) an ethoxylated alcohol, (iii) an amphoteric surfactant, (iv) sodium xylene sulfonate or sodium cumene sulfonate, and (v) at least one additive selected from the group consisting of magnesium oxide, magnesium chloride and sodium hydroxide.

51. A composition according to claim 37, further comprising (i) ethanol, (ii) an ethoxylated alcohol, and (iii) an amphoteric surfactant.

52. A composition according to claim 37, further comprising (i) ethanol, (ii) sodium xylene sulfonate or sodium cumene sulfonate, and (iii) at least one additive selected from the group consisting of magnesium oxide, magnesium chloride and sodium hydroxide.

53. A method according to claim 40, wherein the detergent composition further comprises at least one additive selected from the group consisting of a $C_8$–$C_{18}$ sulfosuccinate, a $C_8$–$C_{18}$ sulfosuccinamate, a $C_8$–$C_{18}$ surcosinate, and alkali metal, alkaline earth metal, amine and ammonium salts thereof.

54. A method according to claim 40, wherein the detergent composition further comprises (i) ethanol, (ii) an ethoxylated alcohol, (iii) an amphoteric surfactant, (iv) sodium xylene sulfonate or sodium cumene sulfonate, and (v) at least one additive selected from the group consisting of magnesium oxide, magnesium chloride and sodium hydroxide.

55. A method according to claim 40, wherein the detergent composition further comprises (i) ethanol, (ii) an ethoxylated alcohol, and (iii) an amphoteric surfactant.

56. A method according to claim 40, wherein the detergent composition further comprises (i) ethanol, (ii) sodium xylene sulfonate or sodium cumene sulfonate, and (iii) at least one additive selected from the group consisting of magnesium oxide, magnesium chloride and sodium hydroxide.

* * * * *